US007378213B2

(12) United States Patent
Tomita et al.

(10) Patent No.: US 7,378,213 B2
(45) Date of Patent: May 27, 2008

(54) IMAGE FORMING PROCESS AND IMAGE FORMING APPARATUS

(75) Inventors: Masami Tomita, Shizuoka (JP); Hiroaki Matsuda, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 361 days.

(21) Appl. No.: 10/729,960

(22) Filed: Dec. 9, 2003

(65) Prior Publication Data

US 2004/0137356 A1 Jul. 15, 2004

(30) Foreign Application Priority Data

Dec. 10, 2002 (JP) ..... 2002-358435
Jul. 24, 2003 (JP) ..... 2003-201202

(51) Int. Cl.
*G03G 13/20* (2006.01)

(52) U.S. Cl. ..... 430/124.3; 430/109.4; 430/110.3; 430/110.4; 430/111.4; 430/123.53; 430/123.54

(58) Field of Classification Search ..... 430/124, 430/110.3, 110.4, 109.4, 111.4, 124.3, 123.53, 430/123.54, 123.52; 399/329
See application file for complete search history.

(56) References Cited

U.S. PATENT DOCUMENTS 4,562,136 A 12/1985 Inoue et al.
4,590,141 A 5/1986 Aoki et al.
4,758,489 A 7/1988 Tomita et al.
4,762,763 A 8/1988 Nomura et al.
4,888,263 A 12/1989 Tomita et al.
4,931,374 A 6/1990 Tomita et al.
5,164,774 A 11/1992 Tomita et al.
5,225,303 A 7/1993 Tomita et al.
5,244,765 A 9/1993 Katoh et al.

(Continued)

FOREIGN PATENT DOCUMENTS

JP 07-319367 12/1995

(Continued)

OTHER PUBLICATIONS

Japanese Patent Office machine-assisted translation of JP 2000-267331 (pub. Sep. 2000).*

(Continued)

*Primary Examiner*—Janis L. Dote
(74) *Attorney, Agent, or Firm*—Oblon, Spivak, McClelland, Maier & Neustadt, P.C.

(57) ABSTRACT

A process contains in which heating and fixing an image of a toner on a recording medium is performed by heating one or more heat-transfer media by a heating element, and pressing the recording medium bearing the toner image to one of the heat-transfer media. At least one of the heat-transfer media is a belt heat-transfer medium with or without the application of an oil whose amount is 4 mg or less per A4 size, and the toner contain a binder resin and a releasing agent, has a weight-average particle diameter Dv of 3.0 to 7.0 μm, a particle diameter distribution Dv/Dn of 1.00 or more and 1.25 or less, wherein Dn is a number-average particle diameter, and an average shape factor SF-1 of 100 to 150 and contains toner particles having a shape factor SF-1 of 160 or more in an amount of 10% by number or less.

10 Claims, 5 Drawing Sheets

U.S. PATENT DOCUMENTS

| | | | | |
|---|---|---|---|---|
| 5,403,690 | A | 4/1995 | Kuramoto et al. | |
| 5,474,869 | A | 12/1995 | Tomita et al. | |
| 5,721,083 | A | 2/1998 | Masuda et al. | |
| 5,797,070 | A * | 8/1998 | Waki et al. | 399/149 |
| 5,840,456 | A | 11/1998 | Tomita et al. | |
| 5,851,716 | A | 12/1998 | Kuramoto et al. | 430/126 |
| 5,975,446 | A | 11/1999 | Yaguchi et al. | 241/76 |
| 6,074,794 | A | 6/2000 | Fushimi et al. | |
| 6,103,441 | A | 8/2000 | Tomita et al. | |
| 6,228,550 | B1 | 5/2001 | Matsuda et al. | |
| 6,235,441 | B1 * | 5/2001 | Tanikawa et al. | 430/108.21 |
| 6,335,137 | B1 | 1/2002 | Suzuki et al. | 430/110.1 |
| 6,363,229 | B1 | 3/2002 | Shiraishi et al. | 399/68 |
| 6,468,706 | B2 | 10/2002 | Matsuda et al. | 430/108.6 |
| 6,534,232 | B1 | 3/2003 | Matsuda et al. | 430/111.32 |
| 6,544,704 | B1 | 4/2003 | Matsuda et al. | 430/108.6 |
| 6,586,147 | B2 * | 7/2003 | Iida et al. | 430/45 |
| 6,593,048 | B2 | 7/2003 | Sasaki et al. | 430/106.1 |
| 6,641,967 | B2 * | 11/2003 | Takiguchi et al. | 430/120 |
| 6,656,654 | B2 | 12/2003 | Higuchi et al. | 430/108.3 |
| 6,660,443 | B2 | 12/2003 | Sugiyama et al. | 430/108.4 |
| 6,667,141 | B2 | 12/2003 | Iwamoto et al. | 430/111.4 |
| 6,670,088 | B1 | 12/2003 | Matsuda et al. | 430/111.1 |
| 6,682,866 | B2 | 1/2004 | Sugiyama et al. | 430/108.1 |
| 2001/0003562 | A1 * | 6/2001 | Hachisuka et al. | 399/329 |
| 2003/0027074 | A1 * | 2/2003 | Emoto et al. | 430/124 |
| 2003/0113650 | A1 * | 6/2003 | Suwabe et al. | 430/120 |
| 2004/0053155 | A1 * | 3/2004 | Emoto et al. | 430/137.15 |

FOREIGN PATENT DOCUMENTS

| | | | |
|---|---|---|---|
| JP | 11-024463 | | 1/1999 |
| JP | 2000-267331 | * | 9/2000 |
| JP | 2001-194821 | | 7/2001 |
| JP | 2002-169344 | | 6/2002 |
| JP | 2002-258710 | | 9/2002 |
| JP | 2002-351143 | | 12/2002 |
| WO | WO 02/056116 A1 | * | 7/2002 |

OTHER PUBLICATIONS

USPTO English-language translation of Japanese Patent 2000-267331 A (pub. Sep. 2000).*
USPTO English-language translation of WO 02-056116 A1 (pub. Jul. 2002).*
U.S. Appl. No. 09/905,872, filed Jul. 17, 2001, Sasaki et al., originally filed claims, abstract and drawings.
U.S. Appl. No. 09/965,826, filed Oct. 1, 2001, Higuchi et al., originally filed claims, abstract and drawings.
U.S. Appl. No. 09/964,622, filed Sep. 28, 2001, Nanya et al., originally filed claims, abstract and drawings.
U.S. Appl. No. 09/996,585, filed Nov. 30, 2001, Higuchi et al., originally filed claims, abstract and drawings.
U.S. Appl. No. 10/020,925, filed Dec. 19, 2001, Mochizuki et al., originally filed claims, abstract and drawings.
U.S. Appl. No. 10/077,813, filed Feb. 20, 2002, Matsuda et al., originally filed claims, abstract and drawings.
U.S. Appl. No. 10/092,920, filed Mar. 8, 2002, Yamashita, originally filed claims, abstract and drawings.
U.S. Appl. No. 10/086,683, filed Mar. 4, 2002, Matsuda et al., originally filed claims, abstract and drawings.
U.S. Appl. No. 10/101,756, filed Mar. 21, 2002, Sasaki et al., originally filed claims, abstract and drawings.
U.S. Appl. No. 10/112,769, filed Apr. 2, 2002, Yamashita et al., originally filed claims, abstract and drawings.
U.S. Appl. No. 10/151,103, filed May 21, 2002, Kondo et al., originally filed claims, abstract and drawings.
U.S. Appl. No. 10/158,069, filed May 31, 2002, Matsuda et al., originally filed claims, abstract and drawings.
U.S. Appl. No. 10/176,578, filed Jun. 24, 2002, Yagi et al., originally filed claims, abstract and drawings.
U.S. Appl. No. 10/188,049, filed Jul. 3, 2002, Yamashita et al., originally filed claims.
U.S. Appl. No. 10/188,753, filed Jul. 5, 2002, Sugiyama et al., originally filed claims, abstract and drawing.
U.S. Appl. No. 10/246,601, filed Sep. 19, 2002, Emoto et al., originally filed claims, abstract and drawing.
U.S. Appl. No. 10/244,526, filed Sep. 17, 2002, Tomita et al., originally filed claims and abstract.
U.S. Appl. No. 10/247,639, filed Sep. 20, 2002, Yamashita et al., originally filed claims and abstract.
U.S. Appl. No. 10/252,070, filed Sep. 23, 2002, Aoki et al., originally filed claims, abstract and drawings.
U.S. Appl. No. 10/286,816, filed Nov. 4, 2002, Emoto et al., originally filed claims, abstract and drawings.
U.S. Appl. No. 10/284,177, filed Oct. 31, 2002, Yagi et al., originally filed claims, abstract and drawings.
U.S. Appl. No. 10/286,791, filed Nov. 4, 2002, Yamashita et al., originally filed claims and abstract.
U.S. Appl. No. 10/385,719, filed Mar. 12, 2003, Sugiura et al., originally filed claims, abstract and drawings.
U.S. Appl. No. 10/392,894, filed Mar. 21, 2003, Yamashita et al., originally filed claims, abstract and drawings.
U.S. Appl. No. 10/394,265, filed Mar. 24, 2003, Nanya et al., originally filed claims and abstract.
U.S. Appl. No. 10/607,014, filed Jun. 27, 2003, Tomita et al., originally filed claims, abstract, and drawings.
U.S. Appl. No. 10/250,667, filed Jul. 7, 2003, Emoto et al., originally filed claims and abstract.
U.S. Appl. No. 10/618,640, filed Jul. 15, 2003, Sugiura et al., originally filed claims, abstract and drawings.
U.S. Appl. No. 10/665,536, filed Sep. 22, 2003, Motoyama, originally filed claims, abstract and drawings.
U.S. Appl. No. 10/921,993, filed Aug. 20, 2004, Amemiya et al.
U.S. Appl. No. 10/921,923, filed Aug. 20, 2004, Koike et al.
U.S. Appl. No. 10/960,084, filed Oct. 8, 2004, Yamada et al.
U.S. Appl. No. 10/959,663 filed Oct. 7, 2004, Sugiura et al.
U.S. Appl. No. 10/969,076, filed Oct. 21, 2004, Uchinokura et al.
U.S. Appl. No. 11/100,813, filed Apr. 7, 2005, Ojimi et al.
U.S. Appl. No. 11/149,373, filed Jun. 10, 2005, Tomita.
U.S. Appl. No. 11/512,385, filed Aug. 30, 2006, Tomita.
U.S. Appl. No. 11/734,895, filed Apr. 13, 2007, Yamashita et al.

* cited by examiner

IMAGE FORMING PROCESS AND IMAGE FORMING APPARATUS

BACKGROUND OF THE INVENTION

1. Field of the Invention

The present invention relates to an image forming process and apparatus using a toner for developing a latent electrostatic image formed on a latent electrostatic image bearing member such as a photoconductor. The process and apparatus are used in the fields of, for example, electrophotography, electrostatic recording and electrostatic printing.

2. Description of the Related Art

In electrophotographic image formation, a latent image is electrostatically formed on an image bearing member such as of a photoconductive substance, and charged toner particles are applied to the latent electrostatic image to thereby form a developed visible image. The visible image formed from the toner is transferred to a transfer medium such as a sheet of paper and is fixed thereon by action of, for example, heat, pressure or solvent evaporation to form an image output.

Processes for charging toner particles to form a visible image in the electrophotographic image formation are roughly classified as "two-component developing processes" in which toner particles are charged as a result of friction by stirring and mixing with carrier particles, and as "one-component developing processes" in which toner particles are charged without the use of carrier particles. The one-component developing processes are then classified as magnetic one-component developing processes and non-magnetic one-component developing processes based on whether or not magnetic power is used for maintaining the toner particles on a development roller.

To fix such a developed visible image, hot-press image-fixing is preferably employed, in which a fixing member such as a fixing roller or fixing belt is directly pressed to an unfixed image to heat and fuse the toner to thereby fix the toner image onto an image bearing member such as a sheet of paper. The hot-press image-fixing technique has a high thermal efficiency, can use a simple image-fixing mechanism and can use a fixing member that can be produced at low cost.

Among such image-fixing mechanisms, an image-fixing mechanism (hereinafter referred to as "belt fixing system") using a belt heat-transfer medium (hereinafter briefly referred to as "fixing belt") has been widely used for energy conservation and miniaturization of apparatus.

According to the belt fixing system, the belt can be in contact with the surface of the toner for a longer time in image fixing process, and the image can be fixed at lower temperature. However, it may often invite an "offset" phenomenon in which the fused toner adheres to the surface of the belt, since the fusing of the toner is accelerated. The belt fixing system often invites offset particularly in color toners, since the color toners comprise a binder resin having a sharp molecular weight distribution and exhibiting sharp melt in order to provide sufficient transparency and appropriate gloss for high quality and to fuse the toner more rapidly in image-fixing.

As the belt heat-transfer medium, endless or regular belts comprising a heat-resistant resin are often used, these resinous belts must be improved in mechanical durability.

In addition, an external additive and other components of the toner adhere to the belt heat-transfer medium to thereby wear or damage the belt. Thus hot offset may occur and the belt heat-transfer medium itself may break.

To solve these problems, a variety of proposals have been made on image fixing mechanisms and toners for developing latent electrostatic images.

An example of proposed image-fixing mechanisms can be found in a presentation "Discussion on On-demand Image Fixing Techniques (A-11)" in Japan Hardcopy '94, Technical Conference of The Imaging Society of Japan (Jun. 23-24, 1994).

However, improvement in the image-fixing mechanism alone cannot fundamentally solve the above problems.

To prevent the offset in image fixing, a releasing material such as wax may be added to a toner. However, when the wax has inappropriate properties or is dispersed inappropriately in the toner, the wax leaves or bleeds out from a surface of the toner in long-term usage in a development unit. In a two-component developer, the bled out wax may stain the surface of the carrier to thereby deteriorate charging ability of the toner. In a one-component developer, the wax may fuse and attach to a development roller or a blade for controlling the thickness of the toner to thereby inhibit uniform development of a toner image. From the viewpoint of development, therefore, the amount of a wax should be preferably minimized.

Conventional toners prepared by kneading and pulverization generally have an irregular shape, have a broad particle diameter distribution, exhibit low fluidity and low transfer ability, require high image-fixing energy and have low stability in charge due to uneven charges among toner particles. Such pulverized toners often adhere to a carrier, a latent electrostatic image bearing member such as a photoconductor and/or a blade in image fixing, although the toners exhibit higher releasability. This is because more wax is exposed from a surface of the pulverized toners, since a toner material article tends to break at portions where the wax occurs as a result of pulverization, and such broken portions of the wax constitute surfaces of the toner particles.

As a possible solution to these problems in the pulverized toners, a method for producing a toner by polymerization has been proposed. The method does not require kneading and pulverizing processes and can save energy, shorten the production time, improve yields of products and can significantly reduce cost. As compared with the pulverization method, the polymerization method can easily produce toner particles having a sharp particle diameter distribution, enables the wax to be included in the toner particles easily, can yield toners having significantly improved fluidity and can yield spherical toner particles.

However, toners prepared by the polymerization method still have some problems. The polymerized toners have insufficient mechanical properties, although they have a higher sphericity of toner particles than the pulverized toners, since surface tension acts upon toner particles in polymerization process. The polymerization method cannot easily control the shape of toner particles to a desired shape, although the resulting toner has stable charge ability and excellent transfer ability.

Among such polymerization processes, suspension polymerization is widely employed. However, the suspension polymerization must use, as a monomer for a binder resin, styrene monomers and/or acrylic monomers harmful to the human body and yields a toner containing these harmful components, thus inviting environmental pollution. The polymerized toner includes a wax inside thereof, which wax is hardly exposed from the particle surface, and does not so much contribute to image fixing as compared with the pulverized toner which has a wax component exposed from its surface, although the polymerized toner is resistant to adhere to a photoconductor when used in an actual image-forming apparatus. The polymerized toner is therefore disadvantageous in power consumption. When the polymerized toner contains a larger amount of a wax or contains a wax having a larger dispersed particle diameter and is used as a color toner, it yields a color image with deteriorated transparency and is not suitable for a toner for forming an image through an overhead projector (OHP).

Such a polymerized toner can also be prepared by emulsion polymerization. However, the emulsion polymerization must use styrene monomers as a monomer component. In the emulsion polymerization, unreacted monomer components, an emulsifier, and a dispersing agent may not be significantly completely removed from toner particles, thus inviting environmental pollution due to the toner.

Certain toners are prepared by dissolution suspension. The dissolution suspension can use a polyester resin that can undergo image-fixing at low temperature. However, a high-molecular weight component is used in a process for dissolving or dispersing toner materials such as the resin and a coloring agent in a solvent, and the resulting solution or dispersion has an increased viscosity to thereby decrease the productivity. Japanese Patent Application Laid-Open (JP-A) No. 09-15903 discloses a toner prepared by the dissolution suspension and having a spherical shape with a rough surface for more satisfactory cleaning up of the residual toner. However, when wax is added to a composition of this toner as a releasing agent, the wax is not sufficiently uniformly dispersed and is not exposed from the toner surface, and the coloring agent (pigment) is not sufficiently uniformly dispersed as compared with the pulverized toners. In addition, a polymer binder (binder resin) for use herein cannot be freely designed, since a high polymer may become particles in the solvent to thereby increase the viscosity. Thus, the toner may not exhibit satisfactory releasability.

JP-A No. 11-133665 proposes a dry toner containing an elongation product of a urethane-modified polyester and having a practical sphericity of 0.90 to 1.00 as a toner binder in order to improve the fluidity, image-fixing properties at low temperature, and hot-offset resistance of the toner. JP-A No. 11-149180 and JP-A No. 2000-292981 disclose dry toners having a small average particle diameter, which are excellent in fluidity, transfer ability, storage stability at high temperature, image-fixing properties at low temperature, and hot-offset resistance. In the publications, these toners are prepared by a method including a process for increasing molecular weight in which an isocyanate-containing polyester prepolymer is subjected to additional polymerization with an amine in an aqueous medium.

The toners prepared by the method, however, contain heterogeneously dispersed pigment and wax components and yield images with low transparency and decreased chromaticness (colorfulness). The toners cannot exhibit satisfactory releasability when they are used in an oil-less image fixing procedure, since they do not contain a satisfactorily controlled dispersed particles of releasing agent. When the toners are used for forming a color image on an OHP sheet, the image is dark or dim due to a large particles diameter of the dispersed releasing agent.

Objects and Advantages

Under these circumstances, an object of the present invention is to provide an image forming process and apparatus that can fix images satisfactorily at low temperature for energy saving, exhibit satisfactory hot-offset resistance and storage stability at high temperature, satisfactory gloss for use as color toners and sufficient transparency for use in an OHP and can form images with very stable good quality in actual use over a long period of time.

SUMMARY OF THE INVENTION

The present inventors have found that the above objects can be achieved by clarifying interaction between a belt heat-transfer medium used in an image-fixing device and a toner for latent electrostatic image development for use in an image forming process using the image-fixing device and clarifying effective ranges of such interactions.

Specifically, the present invention provides:

(1) an image forming process including the step of fixing a toner image on a recording medium. The step of fixing including heating one or more heat-transfer media using a heating element, and pressing the recording medium bearing the toner image to one of the one or more heat-transfer media. Here, at least one of the one or more heat-transfer media is a belt heat-transfer medium and the surface thereof is applied with oil in an amount of 4 mg or less per A4 size, and the toner image is formed with a toner containing a binder resin and a releasing agent. The toner has Dv of from 3.0 μm to 7.0 μm, a particle diameter distribution Dv/Dn of from 1.00 to 1.25, where Dv is a weight-average particle diameter and Dn is a number-average particle diameter. Moreover, the toner has an average shape factor SF-1 of from 100 to 150, and contains toner particles having a shape factor SF-1 of 160 or more in an amount of 10% by number or less;

(2) the image forming process according to (1), in which the weight-average particle diameter Dv of the toner is in the range of 3.0 μm to 5.0 μm;

(3) the image forming process according to (1), in which the particle diameter distribution Dv/Dn of the toner is in the range of from 1.00 to 1.20;

(4) the image forming process according to (1), in which the average shape factor SF-1 of the toner is in the range of from 100 to 130;

(5) the image forming process according to (1), in which a content of toner having a shape factor SF-1 of 150 or more in the toner is 10% by number or less;

(6) the image forming process according to (1), in which the releasing agent has a melting point of from 60° C. to 120° C. and is contained in the toner in an amount of from 1% by weight to 20% by weight;

(7) the image forming process according to (1), in which the releasing agent in each toner particle is dispersed in a form of particles, the dispersed particles of the releasing agent having a particle diameter of from 0.1 μm to 3 μm occupy 80% by number or more of the total dispersion particles, and the dispersed particles is concentrated in the vicinity of the surface of the toner particle as observed with a transmission electron microscope (TEM);

(8) the image forming process according to (1), in which the toner particles have a storage modulus G' and a loss modulus G", wherein the storage modulus G' is in the range from $5.5\times10^5$ Pa to $5.5\times10^7$ Pa at 80° C. and is in the range from $5.0\times10^2$ Pa to $1.0\times10^4$ Pa at 180° C., and a maximum of a loss tangent ($\tan\delta=G''/G'$) is in the range from 1.5 to 8.0 at temperature from 80° C. to 130° C.;

(9) the image forming process according to (1), in which the binder resin has an acid value of from 1 mg-KOH/g to 50 mg-KOH/g;

(10) the image forming process according to (1), in which the binder resin has a glass transition point of from 40° C. to 60° C.;

(11) the image forming process according to (1), in which the binder resin contains a polyeister resin having a tetrahydrofuran-soluble component, such tetrahydrofuran-soluble component has a molecular weight distribution with a main peak at molecular weights of from 2,500 to 10,000 and with a number-average molecular weight of from 2,500 to 50,000;

(12) the image forming process according to (1), in which the toner is a toner which is prepared by:

at least one of dissolving and dispersing, in an organic solvent, an isocyanate-containing polyester prepolymer, a compound capable at least one of undergoing elongation and crosslinking with the prepolymer, and at least one toner component to form one of a solution and dispersion;

subjecting one of the solution and the dispersion to at least one of a crosslinking reaction and an elongation reaction in an aqueous medium to form a dispersion; and removing the solvent from the dispersion;

(13) the image forming process according to (1), further containing a step of supplying a toner with a latent electrostatic image formed on the photoconductor and applying an alternating field so that a toner image is formed to develop the latent electrostatic image;

(14) the image forming apparatus, containing: a photoconductor; a charging unit configured to charge the photoconductor; an exposing unit configured to expose the charged photoconductor imagewise so as to form a latent electrostatic image on the photoconductor; a developing unit configured to house a toner therein and supply the toner to the latent electrostatic image so as to form a toner image; a transfer unit configured to transfer the toner image onto a recording medium; and a fixing unit configured to heat and press the toner image so as to fix the toner image onto the recording medium, wherein the fixing unit comprises: one or more heat-transfer media wherein at least one of the heat-transfer media is a belt heat-transfer medium; a heating element configured to heat the one or more heat-transfer media; and a pressurizing member configured to press the recording medium and bring the recording medium to be in a contact with one of the one or more heat-transfer media, wherein the toner contains: a binder resin; and a releasing agent, in which the toner has Dv of from 3.0 μm to 7.0 μm, a particle diameter distribution Dv/Dn of from 1.00 to 1.25, wherein Dv is a weight-average particle diameter and Dn is a number-average particle diameter, and an average shape factor SF-1 of from 100 to 150, and contains toner particles having a shape factor SF-1 of 160 or more in an amount of 10% by number or less;

(15) the image forming apparatus according to (14), further containing an oil-application unit configured to apply oil to the surface of the belt heat-transfer medium in an amount of 4 mg or less per A4 size;

(16) the image forming apparatus according to (14), in which the weight-average particle diameter Dv of the toner is in the range of from 3.0 μm to 5.0 μm;

(17) the image forming apparatus according to (14), in which the particle diameter distribution Dv/Dn is in the range of from 1.00 to 1.20;

(18) the image forming apparatus according to (14), in which the average shape factor SF-1 of the toner is in the range of from 100 to 130;

(19) the image forming apparatus according to (14), in which the content of toner particles having a shape factor SF-1 of 150 or more in the toner is 10% by number or less;

(20) the image forming apparatus according to (14), in which the releasing agent has a melting point of 60° C. to 120° C. and is contained in the toner in an amount of from 1% by weight to 20% by weight;

(21) the image forming apparatus according to (14), in which the releasing agent in each toner particle is dispersed in a form of particles, dispersed particles of the releasing agent having an average particle diameter of 0.1 μm to 3 μm occupy 80% by number or more of the total dispersed particles, and the dispersed particles is concentrated in the vicinity of the surface of the toner particle as observed with a transmission electron microscope (TEM);

(22) the image forming apparatus according to (14), in which a storage modulus G' is in the range from $5.5\times10^5$ Pa to $5.5\times10^7$ Pa at 80° C. and is in a range from $5.0\times10^2$ Pa to $1.0\times10^4$ Pa at 180° C., and a maximum of a loss tangent (tan $\delta$=G"/G') is in a range from 1.5 to 8.0 at temperature from 80° C. to 130° C., where the toner has a storage modulus G' and a loss modulus G";

(23) the image forming apparatus according to (14), in which the binder resin has an acid value of from 1 mg-KOH/g to 50 mg-KOH/g;

(24) the image forming apparatus according to (14), in which the binder resin has a glass transition point of 40° C. to 60° C.;

(25) the image forming apparatus according to (14), in which the binder resin contains a polyester resin having a tetrahydrofuran-soluble component, such tetrahydrofuran-soluble component has a molecular weight distribution with a main peak at molecular weights of 2,500 to 10,000 and with a number-average molecular weight of 2,500 to 50,000;

(26) the image forming apparatus according to (14), in which the toner is a toner which is prepared by: at least one of dissolving and dispersing, in an organic solvent, an isocyanate-containing polyester prepolymer, a compound capable of undergoing elongation or crosslinking with the prepolymer, and at least one toner component to form one of a solution and a dispersion; subjecting one of the solution and the dispersion to at least one of a crosslinking reaction and an elongation reaction in an aqueous medium to form a dispersion; and removing the solvent from the dispersion;

(27) the image forming apparatus according to (14), in which the photoconductor is an amorphous silicon photoconductor;

(28) the image forming apparatus according to (14), in which the charging unit contains a charging member in which the charging member is subjected to be in contact with the photoconductor and be applied with voltage so as to charge the photoconductor;

(29) a process cartridge containing: a photoconductor; a developing unit configured to house a toner therein; and at least one of a charging unit and a cleaning unit, in which the toner contains a binder resin and a releasing agent, has a weight-average particle diameter Dv of from 3.0 μm to 7.0 μm, a particle diameter distribution Dv/Dn of from 1.00 to 1.25, in which Dv is the weight-average particle diameter and Dn is a number-average particle diameter, and an average shape factor SF-1 of from 100 to 150 and contains toner particles having a shape factor SF-1 of 160 or more in an amount of 10% by number or less.

Further objects, features and advantages of the present invention will become apparent from the following description of the preferred embodiments with reference to the attached drawings.

DESCRIPTION OF THE PREFERRED EMBODIMENTS

The image forming process of the present invention contains the step of fixing a toner image on a recording medium. The step of fixing contains heating one ore more heat-transfer media using a heating element, and pressing the recording medium beating the toner image to one of the heat-transfer media using pressurizing member. Here, at least one of the heat-transfer media is a belt heat-transfer medium and is applied with oil in an amount of 4 mg or less per A4 size. The toner for use in the image forming process of the present invention is not limited provided that the toner contains a binder resin and a releasing agent, has a weight-average particle diameter Dv of from 3.0 μm to 7.0 μm, a particle diameter distribution Dv/Dn of from 1.00 to 1.25, where Dv is the weight-average particle diameter and Dn is a number-average particle diameter, has an average shape factor SF-1 of from 100 to 150, and contains toner particles having a shape factor SF-1 of 160 or more in an amount of 10% by number or less. The image forming process of the present invention may further contain any suitable steps depending on the purpose. Such steps are, for example, a step of charging a photoconductor uniformly, exposing the charged photoconductor to light imagewise so as to form a latent electrostatic image, and supplying a toner to the latent electrostatic image so as to develop the latent image, a step of transferring the toner image from the photoconductor onto a recording medium, and the like.

The image forming apparatus of the present invention contains a photoconductor, a charging unit configured to charge the photoconductor, an exposing unit configured to expose the charged photoconductor imagewise so as to form a latent electrostatic image on the photoconductor, a developing unit configured to house a toner therein and supply the toner to the latent electrostatic image so as to form a toner image, a transfer unit configured to transfer the toner image onto a recording medium, and a fixing unit configured to heat and press the toner image so as to fix the toner image onto the recording medium. The above-mentioned fixing unit contains one or more heat-transfer media in which at least one of them is a belt heat-transfer medium, a heating element configured to heat the heat-transfer media and pressurizing member configured to press the recording medium and bring the recording medium to be in contact with one of the heat-transfer media. The toner for use in the image forming apparatus is not limited provided that the toner contains a binder resin and a releasing agent, has a weight-average particle diameter Dv of from 3.0 μm to 7.0 μm, a particle diameter distribution Dv/Dn of from 1.00 to 1.25, where Dv is the weight-average particle diameter and Dn is a number-average particle diameter, has an average shape factor SF-1 of from 100 to 150, and contains toner particles having a shape factor SF-1 of 160 or more in an amount of 10% by number or less.

Figure 1:
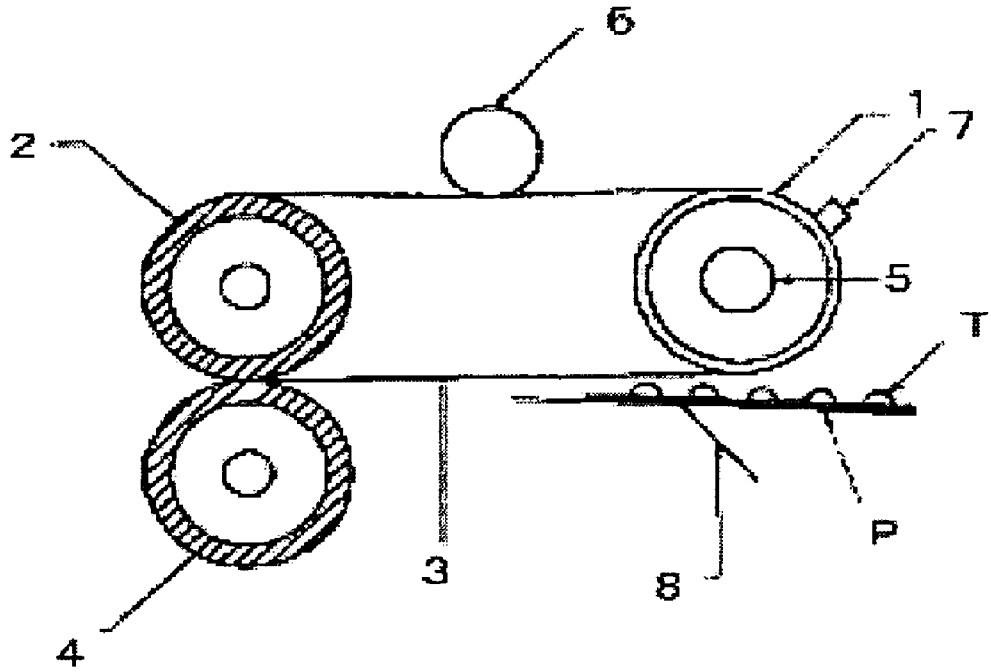
FIG. 1 is a schematic diagram illustrating a fixing device.

FIG. 1 is a schematic diagram illustrating an example of an image-fixing device for use in the image forming process of the present invention. The image-fixing device includes a fixing roller 2, a heating roller 1, a fixing belt 3, a press roller 4, and a thermosensor 7. The fixing roller 2 comprises a rod of a metal such as aluminum or iron, and a coating layer of an elastic substance such as silicone rubber covering the rod. The heating roller 1 comprises a hollow cylindrical rod or pipe made of a metal such as aluminum, iron, copper or stainless steel, and a heat source 5 inside thereof. The fixing belt 3 is in contact with a part of the heating roller 1, and the temperature sensor 7 serves to determine the surface temperature of the fixing belt 3. The fixing belt 3 is spanned around the fixing roller 2 and the heating roller 1, has a small heat capacity and comprises a base and a releasing layer arranged on the base. The base may comprise, for example, a layer of nickel or polyimide having a thickness of about 30 μm to about 150 μm. The releasing layer may comprise, for example, a silicone rubber layer having a thickness of about 50 μm to about 300 μm or a fluorocarbon resin layer having a thickness of about 10 μm to about 50 μm. The press roller 4 comprises a metallic rod and an elastic layer covering the rod and serves to press the fixing roller 2 with the interposition of the fixing belt 3 from below to thereby form a nip between the fixing belt 3 and the press roller 4.

Dimensions of individual members in the device may be set according to requirements. FIG. 1 also shows an oil-application roller 6, a guide 8, an image-transfer medium P, and a toner T on the image-transfer medium.

The above configuration is shown only by illustration. The present invention can also employ an image-fixing device having a fixing belt with another configuration than above. For example, a heat source may be arranged inside the fixing roller 2 or the press roller 4.

Here, "oil is applied in an amount of 4 mg or less per A4 size" means that the application amount of oil to the surface of the belt heat-transfer medium is in the range of from 0 mg to 4 mg per A4 size, which includes the case that no oil is applied at all.

In the case that the oil-application unit such as oil-application roller or the like showed in the figure is used with a small amount of the applied oil, offset of toner resulted from the deterioration of the belt surface due to use of long period, may be inhibited.

The present inventors have made intensive investigations on the relationship between an image-fixing device using the belt fixing system and the properties of a toner such as image fixing properties, hot-offset resistance, storage stability at high temperature, gloss as a color toner, and transparency used in an OHP. They have found that the particle diameter and shape of toner particles significantly affect the image-fixing properties and other properties. They have also found that, by incorporating a modified polyester as a toner binder into a dry toner, the modified polyester effectively and satisfactorily serves as a dispersing agent for pigment particles constituting a coloring agent, the dry toner contains satisfactorily dispersed pigment particles and finely dispersed releasing agent, thereby has increased transparency and glossiness required as a color toner and, concurrently, can be fixed satisfactorily by belt fixing system and has satisfactory hot-offset resistance. In addition, they have found the difference between image fixing using an image-fixing device of belt fixing system and that of roller fixing system. The present invention has been accomplished based on these findings.

The particle diameter and shape of toner particles affect the image fixing properties of the toner probably because the uniformity of a toner layer on an image-transfer medium such as a sheet of paper affects the image fixing properties.

Regarding the particle diameter of the toner particles, the present inventors have found that satisfactory image-fixing properties can be obtained when the toner has a weight-average particle diameter of from 3.0 μm to 7.0 μm, preferably 3.0 μm to 5.0 μm, and a particle diameter distribution Dv/Dn of from 1.00 to 1.25, preferably 1.00 to 1.20, wherein Dv is the weight-average particle diameter and Dn is a number-average particle diameter. If the toner has a weight-average particle diameter less than 3.0 μm or more than 7.0 μm or if it has a particle diameter distribution Dv/Dn more than 1.25 even when the toner has a weight-average particle diameter of from 3.0 μm to 7.0 μm, the toner shows deteriorated image-fixing properties. This is probably because a toner having a weight-average particle diameter and a particle diameter distribution within the above ranges can form a uniform toner layer on the image-transfer medium, which can homogeneously receive heat transferred from an image-fixing member and is homogeneously heated, melted and fixed to the image-transfer medium. In contrast, a toner having a weight-average particle diameter less than 3.0 μm may not sufficiently receive heat and pressure from the image-fixing member when the image-transfer medium has a relatively rough surface and toner particles migrate into depressions on the surface, thus inviting unsatisfactory image fixing. A toner having a weight-average particle diameter exceeding 7.0 μm may not form a uniform toner layer and may not uniformly receive heat, thus inviting insufficient image fixing.

The toner also exhibits satisfactory image-fixing properties when the toner has an average shape factor SF-1 of from 100 to 150, preferably 100 to 130, and contains particles having a shape factor SF-1 of 160 or more in an amount of 10% by number or less, more preferably contains particles having a shape factor SF-1 of 150 or more in an amount of 10% by number or less. This is probably because a toner containing toner particles having the above specified shape factors can form a further more uniform toner layer on the image-transfer medium, which can more uniformly receive heat transferred from an image-fixing member and is heated and melted more uniformly.

The binder resin of the toner for use in the present invention may preferably comprise a polyester resin and/or a polyester modified with, for example, urea groups to ensure satisfactory image-fixing properties at low temperature and transparency as a color toner. In addition, to impart satisfactory releasability to the toner, a releasing agent such as a wax should be preferably finely dispersed and located in the vicinity of surfaces of the toner particles. Thus, the releasing agent can rapidly migrate from the toner particles and can exhibit satisfactory releasability in image fixing.

More specifically, the toner preferably contains dispersed particles of the releasing agent having an average particle diameter of from 0.1 μm to 3 μm in an amount of 70% by number or more. Such particles of the releasing agent are preferably dispersed in the vicinity of the surfaces of toner particles when observed with a transmission electron microscope (TEM). In the present invention, "the vicinity of the surface of the toner particles" denotes a region that lies between the outer circumference of the arbitrary cross section of the toner particle and an inner circumference having a radius being two thirds of the radius of the outer circumference. Moreover, "the dispersed particles is concentrated in the vicinity of the surface of the toner particle" denotes those dispersed wax particles of 70% by number or more relative to the total amount of wax, are located within the above region. The resulting toner can yield high releasability in image fixing. The toner can prevent various problems caused by a releasing agent exposed from the surface in a pulverized toner, such as spent to a carrier, filming to a photoconductor and deteriorated quality of a developer due to variation in charge.

The releasing agent such as a wax is generally dispersed using a regular mixer or stirrer. For example, the releasing agent is dissolved to form a material solution, the material solution is stirred in a dissolution-stirring tank and is subjected to wet pulverization with an apparatus having a granular medium, such as an attritor, a ball mill, a sand mill, and a vibrating mill. The granular medium preferably comprises, for example, stainless steel, carbon steel or another steel, alumina, zirconia or silica.

The toner is preferably prepared by a process in which a toner composition is dissolved or dispersed in an organic solvent, and the solution or dispersion is then dispersed in an aqueous medium to yield toner particles. According to this process, polar group moieties of the modified polyester have hydrophilicity and selectively gather in the surface of the toner particles to thereby prevent the particles of the releasing agent from exposing from the surface. The resulting toner particles include finely dispersed particles of the releasing agent and can avoid filming and unstable charging due to a large particle diameter of a releasing agent and/or the presence of such particles of the releasing agent in the vicinity of the surface.

In the present invention, a coloring agent such as a pigment may be added and dispersed concurrently with the releasing agent. Aggregates of the coloring agent can be dissolved with the mixer to thereby yield dispersed particles of the coloring agent having an average particle diameter of about 0.7 μm or less, and preferably about 0.4 μm or less. The resulting toner has excellent glossiness and transparency and can yield clear images with excellent color reproducibility when used as a color toner.

The particle diameter of dispersed particles of releasing agent is defined as an average of particle diameters in a maximum diameter direction of the particle. Specifically, toner particles are embedded into an epoxy resin and then the epoxy resin is cured. The epoxy resin embedding the toner particles is very finely sliced so as to yield an ultrathin section having a thickness of about 100 μm. The toner particles within the ultrathin section are dyed with ruthenium tetroxide. The ultrathin slices are observed under a transmission electron microscope (TEM) at a magnification of 10,000 times, and pictures of the toner particles are taken and are visually observed to determine the dispersion of the releasing agent. Visual observation is performed on 10 samples of ultrathin slices and the diameter of dispersed particle of releasing agent is determined as an average value taken from the observed 10 samples.

In the toner, it is preferred that dispersed particles of the releasing agent having a particle diameter of 0.1 μm to 3 μm occupy 80% by number or more of the total dispersed particles. More preferably, dispersed particles of the releasing agent having a particle diameter of 1 μm to 2 μm occupy 70% by number or more of the total dispersed particles. If the toner contains an excessively large amount of dispersed particles of the releasing agent having a particle diameter less than 0.1 μm, the toner may not exhibit sufficient releasability. If the toner contains an excessively large amount of dispersed particles of the releasing agent having a particle diameter more than 3 μm, the toner particles may aggregate and have deteriorated fluidity and/or cause filming. In addition, in the case of a color toner, the toner yields images with significantly deteriorated color reproducibility and glossiness.

The releasing agent for use in the present invention can be selected from among known releasing agents and examples are polyolefin wax such as polyethylene wax and polypropylene wax; long-chain hydrocarbons such as paraffin wax and Sasol wax; and carbonyl-containing wax. Among them, carbonyl-containing wax is preferred. Examples of the carbonyl-containing wax are polyalkanoic acid esters such as carnauba wax, montan wax, trimethylolpropane tribehenate, pentaerythritol tetrabehenate, pentaerythritol diacetate dibehenate, glycerol tribehenate, and 1,18-octadecanediol distearate; polyalkanol esters such as tristearyl trimellitate, and distearyl maleate; polyalkanoic acid amides such as ethylenediaminedibehenamide; polyalkylamides such as tristearylamide trimellitate; and dialkyl ketones such as distearyl ketone. Among these, polyalkanoic acid esters are preferred.

The wax has a melting point of from 60° C. to 120° C., and preferably 70° C. to 100° C. Wax with a melting point of lower than 40° C. may adversely affect the storage stability at high temperature. In contrast, wax with a melting point higher than 120° C. may often invite cold offset upon image fixing at low temperature. The wax has a melt viscosity of preferably from 5 cps to 1,000 cps (from 0.005 Pa s to 1 Pa s), and more preferably from 10 cps to 100 cps (from 0.01 Pa s to 0.1 Pa s) as measured at a temperature 20° C. higher than its melting point. A wax with a melt viscosity more than 1,000 cps (1 Pa s) may not satisfactorily contribute to improve hot offset resistance and image-fixing properties at low temperature.

The content of the wax in the toner is from 0% by weight to 40% by weight, and preferably from 3% by weight to 30% by weight.

The dry toner for use in the present invention has a storage modulus G' and a loss modulus G", wherein the storage modulus G' is in the range from $5.5\times10^5$ to $5.5\times10^7$ Pa at 80° C. and is in the range from $5.0\times10^2$ to $1.0\times10^4$ Pa at 180° C., and a maximum of a loss tangent (tan δ=G"/G') is in the range from 1.5 to 8.0 at temperature from 80° C. to 130° C. The dry toner having these viscoelastic properties can ensure satisfactory releasability in the belt fixing system and can concurrently have a good transparency in OHP, in contrast to conventional equivalents. The present inventors consider the reasons therefore as follows.

In roller fixing or belt fixing, a toner is suspected to begin to be actually fixed to an image transfer sheet such as paper at a temperature of about 80° C. to 120° C. based on observation using, for example, a thermolabel. The present inventors have made investigations on the relationship between a melting point and a viscoelasticity of the toner in belt fixing based on the above observation and have found the following findings. A toner having a storage modulus G' of more than $5.5\times10^7$ Pa at 80° C. may invite in insufficient image fixing due to extremely high viscoelasticity. In the belt fixing, the toner having the above-specified viscoelastic properties can be fixed smoothly, since the polyester resin serving as the binder has good affinity for image transfer media such as paper. The belt fixing is performed at a lower fixing pressure than the roller fixing, and the thermal properties of the binder must be so designed and the structure of the toner particles must be so controlled as to yield satisfactory image-fixing properties, hot-offset resistance and glossiness in a color toner. Thus, the toner having the above configuration in its particles can exhibit its advantages.

Conditions for the belt fixing are, for example, as follows.

Belt tension: 1.5 kg/piece

Belt speed: 170 mm/sec

Fixing nip width: 10 mm

Fixing roller having a diameter of 38 mm and comprising foamed silicone having an Asker C hardness of about 30 degrees Press roller having a diameter of 50 mm and comprising a tubular iron rod having a thickness of 1 mm and a diameter of 48 mm, a perfluoro-alkoxyfluoro plastic (PFA) tube covering the rod and a silicon rubber layer having a thickness of 1 mm and having an Asker C hardness of about 75 degrees Heating roller comprising an aluminum tube having a thickness of 2 mm and a diameter of 30 mm Fixing belt having a diameter of 60 mm and a width of 310 mm and comprising a base of nickel having a thickness of about 40 μm and a releasing layer of a silicone rubber having a thickness of about 150 μm A toner having a storage modulus G' of less than $5.5\times10^5$ Pa at 80° C. may not be satisfactorily stored, although it may be fixed without problems.

A toner having a storage modulus G' of less than $5.0\times10^2$ Pa at 180° C. may not have sufficient elasticity to prevent hot offset. A toner having a storage modulus G' of more than $1.0\times10^4$ Pa at 180° C. may have excessively high elasticity and may have a higher lowest fixing temperature, although it may exhibit sufficient hot-offset resistance. In the belt fixing which is performed at a low fixing pressure, the binder must have a sufficiently high viscosity after the beginning of fixing of the toner to yield satisfactory glossiness as a color toner.

Specifically, the binder must have a sufficient viscosity at a temperature of 80° C. to 130° C. at which the toner begins to be fixed. The viscosity herein can be indicated by a loss tangent δ (tan δ=G"/G'). A toner having a maximum of loss tangent δ (tan δ=G"/G') in the range of 1.5 to 8.0 at temperature of 80° C. to 130° C. has sufficient glossiness, as verified by experiment. If the maximum loss tangent is less than 1.5, the toner may not have sufficient glossiness. If it is more than 8.0, the toner may not have satisfactory hot-offset resistance, although the toner may have sufficient glossiness.

The toner exhibits good hot-offset resistance and excellent glossiness provably because the toner comprises the satisfactorily dispersed coloring agent (pigment) and releasing agent. This good dispersibility of the components may prevent a decreased storage modulus G' and may prevent a decreased cohesive force of the toner binder even at temperature of 150° C. to 180° C. to thereby keep its good releasability, even though the toner begins to be fixed at a relatively low temperature of about 80° C.

The viscoelasticity of the toner may be determined by using 1 gram of a sample immobilized on a parallel plate 20 mm wide with a RheoStress RS 50 (trade name, available from Thermo Electron Company, Germany) at a frequency of 1 Hz, temperature from 70° C. to 210° C. and a heating rate of 3° C./min.

The toner preferably contains a releasing agent having a melting point of 60° C. to 120° C. in a content of 1% by weight to 20% by weight. Thus, a required amount of the releasing agent bleeds out from the toner surface in image fixing to yield sufficient offset resistance.

The binder resin for use in the toner has an acid value of preferably 1 mg-KOH/g to 50 mg-KOH/g, and more preferably 5 mg-KOH/g to 30 mg-KOH/g, a glass transition point Tg of preferably 40° C. to 65° C., and more preferably 45° C. to 60° C., a number-average molecular weight Mn of preferably 2,500 to 50,000 and more preferably 2,500 to 30,000, and a weight-average molecular weight Mw of preferably 5,000 to $10\times10^4$, and more preferably $1\times10^4$ to $4\times10^4$.

The toner for use in the present invention is preferably prepared by a method comprising the steps of dissolving or dispersing, in an organic solvent, a toner composition containing an isocyanate-containing polyester prepolymer, a compound capable of undergoing elongation or crosslinking with the prepolymer, and other toner components to form a solution or dispersion; subjecting the solution or dispersion to a crosslinking reaction and/or an elongation reaction in an aqueous medium to form a dispersion; and removing the solvent from the dispersion. Thus, the toner can have a particle diameter and shape as specified in the present invention and can exhibit improved image fixing properties and improved offset resistance in image fixing.

According to this method, polar group moieties of the modified polyester have hydrophilicity and selectively gather in the surface of the toner particle to thereby prevent the particles of releasing agent from exposing from the surface. The resulting toner particles include finely dispersed particles of the releasing agent and can avoid filming and unstable charging due to a large particle diameter of a releasing agent and/or the presence of such particles of the releasing agent in the vicinity of the surface.

The toner may further contain a coloring agent. To homogeneously disperse the coloring agent in the toner, the toner must be prepared with some scheme. A method under conventional conditions may not produce such a high-quality toner.

To yield the high-quality toner, the formation of an oily dispersion containing a prepolymer, a coloring agent and a releasing agent must employ a process for pulverizing the coloring agent (wet-pulverization process). The coloring agent can be wet-pulverized using any wet-pulverizing device, as long as it applies an impact force to the coloring agent in a liquid to thereby pulverize the coloring agent. Examples of the wet-pulverizing device are conventional wet-pulverizing devices such as a ball mill and a bead mill.

The wet-pulverization is, for example, from 5° C. to 20° C., and preferably from 15° C. to 20° C.

By wet-pulverizing the coloring agent under appropriately controlled conditions, dispersed particles of the coloring agent in the toner particles can have a particle diameter and a particle diameter distribution within the above ranges. The dispersion after the reaction can also be subjected to the wet-pulverization process according to necessity.

Generally, an average particle diameter, and a particle distribution of a toner are measured by a Coulter counter method. The Coulter counter method can be carried out with, for example, Coulter Counter TA-II, Coulter Multisizer II (trade names, available from Beckman Coulter, Inc.). In the present invention, an average particle diameter and a particle diameter distribution of a toner are determined by using the Coulter Counter TA-II connected with a personal computer PC 9801 (trade name, available from NEC Corporation) in which Inter Face (trade name, available from Institute of Japanese Union of Scientists & Engineers) is installed. Inter Face is a software capable of analyzing and outputting number distribution and volume distribution of a toner.

Determination of Weight-average Particle Diameter and Number-average Particle Diameter of Toner Initially, 0.1 ml to 5 ml of a surfactant, preferably an alkylbenzenesulfonate, as a dispersing agent is added to 100 ml to 150 ml of an electrolyte. The electrolyte used herein may be an about 1% aqueous solution of NaCl prepared from an extra pure (first grade) sodium chloride. For example, ISOTON-IL (trade name, available from Beckman Coulter, Inc.) can be used. Next, 2 mg to 20 mg of a test sample was added to the electrolytic solution. The electrolytic solution suspending the test sample was dispersed by an ultrasonic disperser for about 1 minute to 3 minutes. Thereafter, volume and number of toner particles were measured by the above-mentioned apparatus, i.e., the Coulter Counter TA-II (trade name, available from Beckman Coulter, Inc.) with an aperture of 100 μm, and volume particle distribution and number particle distribution were calculated thereby.

As channels, 13 channels of 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm, were used. Here, the object was particles having a diameter range of 2.00 μm to less than 40.30 μm. Then, the weight-average particle diameter Dv based on the volume distribution and the number-average particle diameter Dn based on the number distribution of the toner are determined, and the ratio Dv/Dn of Dv to Dn as the particle diameter distribution is calculated.

Determination of Shape Factor SF-1

The shape factor SF-1 in the present invention can be determined, for example, in the following manner. A sample toner is subjected to scanning electron microscopic (SEM) observation using a scanning electron microscope FE-SEM S-800 available from Hitachi, Ltd. to yield SEM images at a magnification of 500 times. One hundred of SEM images are randomly selected, and image information thereof is analyzed using an image analyzer (available from NIRECO Corporation, under the trade name of Luzex III). The shape factor SF-1 is determined by calculation according to the following equation based on the analyses.

$$SF\text{-}1=[(MXLNG)^2/\mathrm{AREA}]\times(100\pi/4)$$

In the equation, MXLNG is an absolute maximum length of the toner particle; and AREA is a projected area of the toner particle.

The shape factor SF-1 indicates the sphericity of the toner particle.

Toner particles prepared by melt-kneading and pulverization have irregular shapes and generally have a shape factor SF-1 of more than 150.

Determination of Molecular Weight Distribution of Binder Resin Component

The molecular weight distribution of the binder resin component in the toner can be determined, for example, in the following manner.

A column is placed in a heat chamber at 40° C. to have a constant temperature, tetrahydrofuran THF as an eluent is fed at a flow rate of 1 ml/min. to the column at 40° C. A sample solution of a sample resin having a concentration of 0.05% by weight to 0.6% by weight in THF is injected into the column in an amount of 50 μm to 200 μm.

For determination of the molecular weight, the molecular weight distribution of the sample is determined by calculation based on the relationship between the logarithm of a calibration curve prepared using plural types of monodispersed polystyrene reference samples and the measured counts. As the reference polystyrene samples for the preparation of the calibration curve, at least about ten samples may be used. Such reference samples include, for example, those each having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$ available from Pressure Chemical Co. or Tosoh Corporation. A refractive index (RI) detector can be used as the detector.

Examples of the method for producing the toner for use in the present invention are (1) a method in which constitutional materials for the toner are melted, kneaded, pulverized and then classified; (2) a method in which a radically polymerizable monomer composition containing a coloring agent and a chain transfer agent is subjected to suspension polymerization in an aqueous medium; and (3) a radically polymerizable monomer composition containing a chain transfer agent is subjected to emulsion polymerization in an aqueous medium in the presence of a water-soluble polymerization initiator, and the resulting resin particles are fused in an aqueous medium. To achieve the objects of the present invention, the toner is preferably prepared by (4) a method comprising the steps of dissolving or dispersing, in an organic solvent, a prepolymer comprising at least one polyester resin having an isocyanate group, a compound capable of undergoing elongation or crosslinking with the prepolymer, and at least one toner component to form a solution or dispersion; subjecting the solution or dispersion to a crosslinking reaction and/or an elongation reaction in an aqueous medium to form a dispersion; and removing the solvent from the dispersion.

The isocyanate-containing polyester prepolymer can be prepared by preparing a polyester having active hydrogen atoms by polycondensation between a polyol (PO) and a polycarboxylic acid (PC), and allowing the polyester to react with a polyisocyanate (PI). In this case, the active hydrogen group of the polyester includes, for example, hydroxyl groups (alcoholic hydroxyl groups and phenolic hydroxyl groups), amino groups, carboxyl groups, and mercapto groups, of which alcoholic hydroxyl groups are preferred.

Examples of the polyol (PO) include diols (DIO) and trihydric or higher polyols (TO). As the polyol (PO), a diol (DIO) alone or a mixture of a diol (DIO) and a small amount of a polyol (TO) is preferred.

Examples of the diols (DIO) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexanedimethanol, and hydrogenated bisphenol A; bisphenols such as bisphenol A, bisphenol F, and bisphenol S; alkylene oxide (e.g., ethylene oxide, propylene oxide, and butylene oxide) adducts of the aforementioned alicyclic diols; and alkylene oxide (e.g., ethylene oxide, propylene oxide, and butylene oxide) adducts of the aforementioned bisphenols. Among them, alkylene glycols each having 2 to 12 carbon atoms, and alkylene oxide adducts of bisphenols are preferred, of which alkylene oxide adducts of bisphenols alone or in combination with any of alkylene glycols having 2 to 12 carbon atoms are typically preferred.

The trihydric or higher polyols (TO) include, for example, trihydric or higher aliphatic alcohols such as glycerol, trimethylolethane, trimethylolpropane, pentaerythritol, and sorbitol; trihydric or higher phenols such as trisphenol PA, phenol novolacs, and cresol novolacs; and alkylene oxide adducts of these trihydric or higher polyphenols.

The polycarboxylic acid (PC) includes, for example, dicarboxylic acids (DIC) and tri- or higher polycarboxylic acids (TC). As the polycarboxylic acid (PC), a dicarboxylic acid (DIC) alone or in combination with a small amount of a tri- or higher polycarboxylic acid (TC) is preferred.

The dicarboxylic acids (DIC) include, but are not limited to, alkylenedicarboxylic acids such as succinic acid, adipic acid, and sebacic acid; alkenylenedicarboxylic acids such as maleic acid, and fumaric acid; aromatic dicarboxylic acids such as phthalic acid, isophthalic acid, terephthalic acid, and naphthalenedicarboxylic acid. Among them, preferred are alkenylenedicarboxylic acids each having 4 to 20 carbon atoms and aromatic dicarboxylic acids each having 8 to 20 carbon atoms.

The tri- or higher polycarboxylic acids (TC) include, for example, aromatic polycarboxylic acids each having 9 to 20 carbon atoms, such as trimellitic acid and pyromellitic acid. An acid anhydride or lower alkyl ester (e.g., methyl ester, ethyl ester, and propyl ester) of any of the polycarboxylic acids can be used as the polycarboxylic acid to react with the polyol.

The ratio of the polyol to the polycarboxylic acid in terms of the equivalence ratio [OH]/[COOH] of the hydroxyl groups [OH] to the carboxyl groups [COOH] is generally from 2/1 to 1/1, preferably from 1.5/1 to 1/1, and more preferably from 1.3/1 to 1.02/1.

The polyisocyanate (PIC) includes, but is not limited to, aliphatic polyisocyanates such as tetramethylene diisocyanate, hexamethylene diisocyanate, and 2,6-diisocyanatomethyl caproate; alicyclic polyisocyanates such as isophorone diisocyanate, and cyclohexylmethane diisocyanate; aromatic diisocyanates such as tolylene diisocyanate, and diphenylmethane diisocyanate; aromatic-aliphatic diisocyanates such as $\alpha,\alpha,\alpha',\alpha'$-tetramethylxylylene diisocyanate; isocyanurates; blocked products of the polyisocyanates with, for example, phenol derivatives, oximes, or caprolactams; and mixtures of these compounds.

In the preparation of the isocyanate-containing polyester prepolymer, the ratio of the polyisocyanate (PI) to the polyester resin (PE) having active hydrogen atoms is such that in terms of the equivalence ratio [NCO]/[OH] of isocyanate groups [NCO] to hydroxyl groups [OH] of the polyester is generally from 5/1 to 1/1, preferably from 4/1 to 1.2/1, and more preferably from 2.5/1 to 1.5/1. If the ratio [NCO]/[OH] exceeds 5, image-fixing properties at low temperature may deteriorate. If it is less than 1, the urea content in the modified polyester may decrease and thereby hot off-set resistance may deteriorate.

The content of the polyisocyanate (PIC) in the prepolymer (A) having an isocyanate group is generally from 0.5% by weight to 40% by weight, preferably from 1% by weight to 30% by weight, and more preferably from 2% by weight to 20% by weight. If the content is less than 0.5% by weight, the hot off-set resistance may deteriorate, and satisfactory storage stability at high temperature and image-fixing properties at low temperature may not be obtained concurrently. If the content is more than 40% by weight, the image-fixing properties at low temperature may deteriorate.

The isocyanate-containing polyester prepolymer (A) generally has, in average, 1 or more, preferably 1.5 to 3, and more preferably 1.8 to 2.5 isocyanate groups per molecule. If the amount of the isocyanate group per molecule is less than 1, the resulting urea-modified polyester may have a low molecular weight and the hot off-set resistance may deteriorate.

By allowing the isocyanate-containing polyester prepolymer (A) to react with an amine (B), a urea-modified polyester (UMPE) can be prepared. The urea-modified polyester (UMPE) effectively and advantageously serves as a toner binder.

The amine (B) includes, for example, diamines (B1), tri- or higher polyamines (B2), amine alcohols (B3), aminomercaptans (B4), amino acids (B5), and amino-blocked products (B6) of the amines (B1) to (B5).

The diamines (B1) include, but are not limited to, aromatic diamines such as phenylenediamine, diethyltoluenediamine, and 4,4'-diaminodiphenylmethane; alicyclic diamines such as 4,4'-diamino-3,3'-dimethyldicyclohexylmethane, diaminocyclohexanes, and isophoronediamine; and aliphatic diamines such as ethylenediamine, tetramethylenediamine, and hexamethylenediamine.

The tri- or higher polyamines (B2) include, for example, diethylenetriamine, and triethylenetetramine.

The amino alcohols (B3) include, but are not limited to, ethanolamine, and hydroxyethylaniline.

The aminomercaptans (B4) include, for example, aminoethyl mercaptan, and aminopropyl mercaptan.

The amino acids (B5) include, but are not limited to, aminopropionic acid, and aminocaproic acid.

The amino-blocked products (B6) of the amines (B1) to (B5) includes ketimine compounds and oxazoline compounds derived from the amines (B1) to (B5) and ketones such as acetone, methyl ethyl ketone, and methyl isobutyl ketone.

Among these amines (B), preferred are the diamine (B1) alone or in combination with a small amount of the polyamine (B2).

Where necessary, the molecular weight of the urea-modified polyester (UMPE) can be controlled by using an elongation terminator in the reaction between the prepolymer (A) and the amine (B). Such elongation terminators include, but are not limited to, monoamines containing no active hydrogen, such as diethylamine, dibutylamine, butylamine, and laurylamine; and blocked products thereof (ketimine compounds). The amount of the elongation terminator may be set according to the desired molecular weight of the urea-modified polyester.

The ratio of the isocyanate-containing prepolymer (A) to the amine (B) is such that the equivalent ratio [NCO]/[NHx] of an isocyanate group [NCO] in the prepolymer (A) to an amino group [NHx] of the amine (B), wherein x is an integer of 1 or 2, is generally from 1/2 to 2/1, preferably from 1.5/1 to 1/1.5 and more preferably from 1.2/1 to 1/1.2. If the ratio [NCO]/[NHx] exceeds 2/1 or is less than 1/2, the polyester may have a low molecular weight, and the hot off-set resistance may deteriorate.

Another polyester resin (D) that is unreactive with the amine (B) may be incorporated in the aqueous medium in the reaction between the isocyanate-containing prepolymer (A) and the amine (B). The polyester resin (D) may have a Tg of about 35° C. to about 65° C., and preferably 45° C. to 60° C., and a number-average molecular weight Mn of about 2,000 to about 10,000, and preferably 2,500 to 80,000. A urea-modified polyester (UMPE) can be used as the polyester resin (D) and may have urethane bonds in addition to urea bonds. The molar ratio of the urea bond to the urethane bond is generally from 100/0 to 10/90, preferably from 80/20 to 20/80, and more preferably from 60/40 to 30/70. If the molar ratio of the urea bond to the urethane bond is less than 10/90, the hot off-set resistance may deteriorate.

The urea-modified polyester (UMPE) for use herein can be prepared according to a conventional method such as a one-shot method. The weight-average molecular weight of the urea-modified polyester (UMPE) is generally from $1\times10^4$ or more, preferably from $2\times10^4$ to $50\times10^4$, and more preferably from $3\times10^4$ to $10\times10^4$. If the weight-average molecular weight is less than $1\times10^4$, the hot off-set resistance may deteriorate.

In the present invention, the urea-modified polyester (UMPE) can be used alone or in combination with an unmodified polyester (PE) as the binder component of the toner. The combination use of the urea-modified polyester (UMPE) with the unmodified polyester (PE) is more preferred upon use in a full-color apparatus to improve the image-fixing properties at low temperature and gloss than the single use of the urea-modified polyester (UMPE).

The unmodified polyester (PE) and preferred examples thereof include, for example, polycondensation products of a polyol (PO) and a polycarboxylic acid (PC) as in the polyester component of the urea-modified polyester (UMPE). The unmodified polyesters (PE) include unmodified polyesters as well as polyesters modified with a urethane bond or another chemical bond other than urea bond.

The urea-modified polyester (UMPE) and the unmodified polyester (PE) are preferably at least partially compatible or miscible with each other for better image-fixing properties at low temperature and hot-offset resistance. Accordingly, the urea-modified polyester (UMPE) preferably has a polyester component similar to that of the unmodified polyester (PE). The weight ratio of the urea-modified polyester (UMPE) to the unmodified polyester (PE) is generally from 5/95 to 80/20, preferably from 5/95 to 30/70, more preferably from 5/95 to 25/75, and typically preferably from 7/93 to 20/80. If the weight ratio is less than 5/95, the hot offset resistance may deteriorate, and satisfactory storage stability at high temperature and image fixing properties at low temperature may not be obtained concurrently.

The unmodified polyester (PE) has a hydroxyl value of preferably 5 or more and an acid value of generally from 1 mg-KOH/g to 30 mg-KOH/g, and preferably from 5 mg-KOH/g to 20 mg-KOH/g. The use of a unmodified polyester (PE) having an appropriate acid value allows the toner to be easily negatively charged, to have good affinity for paper upon image fixing and to have improved image fixing properties at low temperature. However, if the acid value exceeds 30, the toner may have deteriorated charging stability and may have a varied charge depending on the environment. In addition, a varying acid value may invite insufficient granulation of the addition-polymerization products between the prepolymer (A) and the amine (B), and the resulting emulsion may not be controlled sufficiently.

The binder resin in the toner has a glass transition point Tg of generally from 45° C. to 65° C., and preferably from 45° C. to 60° C. If the glass transition point Tg is lower than 45° C., the heat resistance of the toner may deteriorate. If it exceeds 65° C., the image-fixing properties at low temperature may be insufficient.

Any conventional or known dyes and pigments can be used as the colorant of the present invention. Such dyes and pigments include, but are not limited to, carbon black, nigrosine dyes, black iron oxide, Naphthol Yellow S, Hansa Yellow (10G, 5G, and G), cadmium yellow, yellow iron oxide, yellow ochre, chrome yellow, Titan Yellow, Polyazo Yellow, Oil Yellow, Hansa Yellow (GR, A, RN, and R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof.

The content of the colorant is generally from 1% by weight to 15% by weight, and preferably from 3% by weight to 10% by weight of the toner.

A colorant for use in the present invention may be a master batch prepared by mixing and kneading a pigment with a resin.

Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly (methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

The master batch can be prepared by mixing and kneading a resin for master batch and the colorant under high shearing force. In this procedure, an organic solvent can be used for higher interaction between the colorant and the resin. In addition, a "flushing process" is preferably employed, in which an aqueous paste containing the colorant and water is mixed and kneaded with an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used in mixing and kneading.

The toner may further comprise a charge control agent according to necessity. Charge control agents include known charge control agents such as nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives. Examples of the charge control agents include commercially available products under the trade names of BONTRON 03 (Nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The amount of the charge control agent is not specifically limited, can be set depending on the type of the binder resin, additives, if any, used according to necessity, and the method for preparing the toner including a dispersing process. Its amount is preferably from 0.1 parts by weight to 10 parts by weight, and more preferably from 0.2 parts by weight to 5 parts by weight relative to 100 parts by weight of the binder resin. If the amount is more than 10 parts by weight, the toner may have an excessively high charge, the charge control agent may not sufficiently play its role, the developer may have increased electrostatic attraction to a development roller, may have decreased fluidity or may induce a decreased density of images.

The charge control agent may be incorporated into the toner, for example, (1) by melting and kneading with the master batch and the resin to thereby dissolve or disperse the charge control agent therein, (2) by directly added to the organic solvent during the dispersion procedure, or (3) by immobilizing to the surface of prepared toner particles.

An external additive is preferably added for further improving the fluidity, developing ability, and charging ability of the toner particles. Inorganic fine particles are preferably used as the external additive. The inorganic fine particles have a primary particle diameter of preferably from 5 nm to 2 μm, and more preferably from 5 nm to 500 nm and have a specific surface area as determined by the BET method of preferably from 20 $m^2/g$ to 500 $m^2/g$. The amount of the inorganic fine particles is preferably from 0.01% by weight to 5% by weight, and more preferably from 0.01% by weight to 2.0% by weight of the toner.

Examples of the inorganic fine particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

Other examples of the external additive are polymer particles such as polystyrene, copolymers of methacrylic esters or acrylic esters prepared by soap-free emulsion polymerization, suspension polymerization or dispersion polymerization; silicone resins, benzoguanamine resins, nylon resins, and other polycondensed or thermosetting resins.

A surface treatment is suitably performed on these external additives to improve hydrophobic property so that fluidity and charging ability are inhibited from being impaired even in a high humidity atmosphere. Suitable surface treatment agents are, for example, a silane coupling agent, a sililating agent, a silane coupling agent having a fluorinated alkyl group, an organic titanate coupling agent, an aluminium coupling agent, a silicone oil, and a modified silicone oil.

A cleaning agent (cleaning improver) may also be added in order to remove the developer remained on a photoconductor or on a primary transfer member after transfer. Suitable cleaning agents are, for example, metal salts of stearic acid and other fatty acids such as zinc stearate, and calcium stearate; and poly(methyl methacrylate) fine particles, polystyrene fine particles, and other fine polymer particles prepared by, for example, soap-free emulsion polymerization. Such fine polymer particles preferably have a relatively narrow particle distribution and a volume-average particle diameter of 0.01 μm to 1 μm.

The method for producing the toner for use in the present invention will be illustrated in detail below.

Initially, an isocyanate-containing polyester prepolymer (A) is dissolved in, a coloring agent is dispersed in, and a releasing agent is dissolved or dispersed in an organic solvent to form an oily dispersion (oily dispersion preparation process).

To finely pulverize and uniformly disperse the coloring agent, the oily dispersion is subjected to wet pulverization for about 30 minutes to about 120 minutes with a wet-pulverizing device (wet-pulverization process).

The resulting oily dispersion is dispersed or emulsified in an aqueous medium in the presence of inorganic fine particles and/or polymer fine particles to form an oil-in-water dispersion (emulsion) (dispersing-emulsifying process). In the dispersion, the isocyanate-containing polyester prepolymer (A) is allowed to react with an amine (B) to form a urea-modified polyester resin having urea bonds (UMPE) (reaction process).

As the organic solvent, one that can dissolve the polyester resin therein and is insoluble or slightly soluble in water can be used. The organic solvent has a boiling point of generally from 60° C. to 150° C., and preferably from 70° C. to 120° C. Examples of such organic solvents are ethyl acetate and methyl ethyl ketone.

The aforementioned master batch coloring agent is preferably used as the coloring agent to disperse the coloring agent uniformly and efficiently.

A polyester resin (D) that is not reactive with the amine (B) is preferably used as an auxiliary component. It may be added to the organic solvent or may also be added to the aqueous medium.

A dispersing device for dispersing the oily dispersion in an aqueous medium is not specifically limited and includes known devices such as those of low-speed shearing, high-speed shearing, dispersing by friction, high-pressure jetting, and ultrasonic dispersion systems. To allow the dispersed particles to have an average particle diameter of 2 μm to 20 μm, the high-speed shearing system is preferred. When a high-speed shearing dispersing machine is used, the number of rotation is not specifically limited and is generally from 1,000 rpm to 30,000 rpm and preferably from 5,000 rpm to 20,000 rpm. The dispersion time is not specifically limited and is generally from 0.1 minutes to 5 minutes in a batch system. The dispersing temperature is generally from 0° C. to 150° C. under a pressure (under a load) and preferably from 40° C. to 98° C. The oily dispersion is preferably dispersed at a relatively high temperature for lower viscosity of the dispersion and for easier dispersion.

The amount of the aqueous medium is generally from 50 parts by weight to 2,000 parts by weight, and preferably from 100 parts by weight to 1,000 parts by weight relative to 100 parts by weight of solid contents such as the prepolymer (A), the coloring agent, the releasing agent, and the polyester resin (D) in the oily dispersion. If the amount is less than 50 parts by weight, the solid contents may not be dispersed sufficiently to thereby fail to yield toner particles having a desired average particle diameter. If it exceeds 2,000 parts by weight, it is not economical. Where necessary, a dispersing agent can be used for sharper particle distribution and more stable dispersion.

The oily dispersion is dispersed in the aqueous medium preferably within a shorter time after the wet pulverization.

Aqueous media for use herein may comprise water alone or in combination with an organic solvent that is miscible with water. Such miscible organic solvents include, but are not limited to, alcohols such as methanol, isopropyl alcohol, and ethylene glycol; dimethylformamide; tetrahydrofuran; Cellosorves such as methyl cellosolve; and lower ketones such as acetone and methyl ethyl ketone.

To emulsify and disperse the oily dispersion (oil phase) containing the toner composition into a liquid containing water (aqueous medium), a dispersing agent such as a surfactant or emulsifier may be used. Such dispersing agents include, but are not limited to, alkylbenzene sulfonates, α-olefin sulfonates, phosphoric esters, and other anionic surfactants; alkylamine salts, amino alcohol fatty acid derivatives, polyamine fatty acid derivatives, imidazoline, and other amine salts cationic surfactants, alkyltrimethylammonium salts, dialkyldimethylammonium salts, alkyldimethylbenzylammonium salts, pyridinium salts, alkylisoquinolinum salts, benzethonium chloride, other quaternary ammonium salts cationic surfactants, and other cationic surfactants; fatty acid amide derivatives, polyhydric alcohol derivatives, and other nonionic surfactants; alanine, dodecyl di(aminoethyl) glycine, di(octylaminoethyl) glycine, N-alkyl-N,N-dimethylammonium betaines, and other amphoteric surfactants.

In the present invention, the effects of the surfactants can be obtained in a small amount by using a surfactant having a fluoroalkyl group. Preferred examples of fluoroalkyl-containing anionic surfactants are fluoroalkylcarboxylic acids each containing 2 to 10 carbon atoms, and metallic salts thereof, disodium perfluorooctanesulfonyl glutamate, sodium 3-[omega-fluoroalkyl ($C_6$-$C_{11}$) oxy]-1-alkyl ($C_3$-$C_4$) sulfonate, sodium 3-[omega-fluoroalkanoyl ($C_6$-$C_8$)-N-ethylamino]-1-propanesulfonate, fluoroalkyl (C11-$C_{20}$) carboxylic acids and metallic salts thereof, perfluoroalkyl carboxylic acids ($C_7$-$C_{13}$) and metallic salts thereof, perfluoroalkyl ($C_4$-$C_{12}$) sulfonic acids and metallic salts thereof, perfluorooctanesulfonic acid diethanolamide, N-propyl-N-(2-hydroxyethyl) perfluorooctanesulfonamide, perfluoroalkyl ($C_6$-$C_{10}$) sulfonamide propyl trimethyl ammonium salts, perfluoroalkyl ($C_6$-$C_{10}$)-N-ethylsulfonyl glycine salts, and monoperfluoroaklyl ($C_6$-$C_{16}$) ethyl phosphoric esters.

Such fluoroalkyl-containing anionic surfactants are commercially available under the trade names of, for example, SURFLON S-111, S-112 and S-113 (from Asahi Glass Co., Ltd.), FLUORAD FC-93, FC-95, FC-98 and FC-129 (from Sumitomo 3M Limited), UNIDYNE DS-101 and DS-102 (from Daikin Industries, Ltd.), MEGAFAC F-110, F-120, F-113, F-191, F-812 and F-833 (from Dainippon Ink & Chemicals, Incorporated), EFTOP EF-102, 103, 104, 105, 112, 123A, 123B, 306A, 501, 201 and 204 (from JEMCO Inc.), and FTERGENT F-100 and F-150 (from Neos Co., Ltd.).

Examples of fluoroalkyl-containing cationic surfactants for use in the present invention include aliphatic primary, secondary and tertiary amic acids each having a fluoroalkyl group; aliphatic quaternary ammonium salts such as perfluoroalkyl ($C_6$-$C_{10}$) sulfonamide propyltrimethylammonium salts; benzalkonium salts; benzethonium chloride; pyridinium salts; and imidazolinium salts. Such fluoroalkyl-containing cationic surfactants are commercially available, for example, under the trade names of SURFLON S-121 (from Asahi Glass Co., LTD.), FLUORAD FC-135 (from Sumitomo 3M Limited), UNIDYNE DS-202 (from Daikin Industries, LTD.), MEGAFAC F-150, and F-824 (from Dainippon Ink & Chemicals, Incorporated), EFTOP EF-132 (from JEMCO Inc.), and FTERGENT F-300 (from Neos Co., Ltd.).

In addition, inorganic compounds which are insoluble or hardly soluble in water can be also used as the inorganic fine particles in the aqueous medium. Examples of such inorganic compounds are tricalcium phosphate, calcium carbonate, titanium oxide, colloidal silica, and hydroxyapatite can be also used as the dispersing agent.

Conventional polymer fine particles which are insoluble or hardly soluble in water can be used as the polymer fine particles in the aqueous medium. Examples are fine particles of hydrophobic polymers such as hydrocarbon resins, fluorocarbon resins, and silicone resins.

The fine particles generally have particle diameters smaller than those of the toner particles. For uniform particle diameters, the ratio of the volume-average particle diameter of the fine particles to that of the toner is preferably in the range from 0.001 to 0.3. If the ratio is more than 0.3, the fine particles may not adhere to the surfaces of the toner particles efficiently, and the resulting toner may have a broad particle diameter distribution.

The volume-average particle diameter of the fine particles can be controlled with the above range of the ratio for forming toner particles having a desired particle diameter. For example, to form a toner having a weight-average particle diameter of 5 μm, the weight-average particle diameter of the fine particles is preferably from 0.0025 μm to 1.5 μm, and more preferably form 0.005 μm to 1.0 μm. To form a toner having a volume-average particle diameter of 10 μm, the volume-average particle diameter of the fine particles is preferably from 0.005 μm to 3 μm, and more preferably form 0.05 μm to 2 μm.

In the preparation of the toner, a hydrophilic polymeric substance that can form a polymeric protective colloid in an aqueous medium may be employed as a dispersion stabilizing agent. Examples of monomer components constituting the polymeric substance are as follows.

Acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and ethers thereof such as vinyl methyl ether, vinyl ethyl ether, and vinyl propyl ether; esters of vinyl alcohol and a carboxyl-group-containing compound, such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; vinylpyridine, vinylpyrrolidone, vinylimidazole, ethyleneimine, and other vinyl monomers containing a nitrogen atom or having a nitrogen-containing heterocyclic ring.

Examples of the polymer substance also include polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxyethyl cellulose, and hydroxypropyl cellulose.

The liquid media (solvent) can be removed from the emulsion prepared as a result of the addition polymerization between the prepolymer (A) and the amine (B) by gradually heating the entire system to thereby evaporate and remove the organic solvent (medium removing process). The sphericity (circularity) of the toner particles can be controlled by adjusting the magnitude of stirring of the emulsion before the removal of the organic solvent and the time period for removing the organic solvent. By slowly removing the solvent, the toner particles have a substantially spherical shape with a sphericity of 0.980 or more. By vigorously stirring the emulsion and removing the solvent in a short time, the toner particles have a rough or irregular shape with a sphericity of about 0.900 to 0.950. More specifically, the sphericity can be controlled within a range from 0.850 to 0.990 by removing the solvent from the emulsion after the emulsification and the reaction while stirring the emulsion with a high stirring power at a temperature of 30° C. to 50° C. in a stirring chamber. By rapidly removing the organic solvent such as ethyl acetate during granulation, formed particles may undergo volume shrinkage to thereby have a certain shape with a certain sphericity.

The media or solvents can also be removed by a process in which the emulsion is sprayed into a dry atmosphere to remove the organic solvent completely to thereby form fine toner particles, and concurrently the aqueous medium is removed by evaporation. The dry atmosphere to which the emulsion is sprayed includes, for example, heated gases such as air, nitrogen gas, carbon dioxide gas, and combustion gas. The gas is preferably heated to a temperature higher than the boiling point of a solvent having the highest boiling point. A desired product can be obtained by short-time drying using a dryer such as spray dryer, belt dryer or rotary kiln.

The time period between the reaction and the removal of the solvent from the emulsion is preferably minimized. The time period is generally 25 hours or less.

When calcium phosphate or other inorganic fine particles that are soluble in an acid or base is used, the inorganic fine particles can be removed from the fine particles by dissolving the dispersion stabilizer by action of an acid such as hydrochloric acid and washing the fine particles. Alternatively, they can be removed by, for example, enzymatic decomposition.

When a dispersing agent is used, the dispersing agent may be allowed to remain on the surface of the toner particles but is preferably removed by washing after the reaction between the prepolymer (A) and the amine (B) for better toner charge ability.

In addition, a solvent that can dissolve the urea-modified polyester (UMPE) and/or the prepolymer (A) can be used for a lower viscosity of the dispersion (toner composition) after the reaction and for a sharper particle distribution. The solvent is preferably volatile and has a melting point of lower than 100° C. for easier removal. Such solvents include, but are not limited to, toluene, xylenes, benzene, carbon tetrachloride, methylene chloride, 1,2-dichloroethane, 1,1,2-trichloroethane, trichloroethylenes, chloroform, monochlorobenzene, dichloroethylidene, methyl acetate, ethyl acetate, methyl ethyl ketone, and methyl isobutyl ketone. Each of these solvents can be used alone or in combination. Among them, preferred solvents are toluene, xylene, and other aromatic hydrocarbon solvents, methylene chloride, 1,2-dichloroethane, chloroform, carbon tetrachloride, and other halogenated hydrocarbons. The amount of the solvent is generally from 0 to 300 parts by weight, preferably from 0 to 100 parts by weight, and more preferably from 25 parts by weight to 70 parts by weight, relative to 100 parts by weight of the prepolymer (A). The solvent, if used, is removed by heating at atmospheric pressure or under reduced pressure after the elongation and/or crosslinking reaction.

The reaction time between the prepolymer (A) and the amine (B) is appropriately set depending on the reactivity derived from the combination of the isocyanate structure of the polyester prepolymer (A) and the amine (B) and is generally from 10 minutes to 40 hours and preferably from 2 hours to 24 hours. The reaction temperature is generally from 0° C. to 150° C. and preferably from 40° C. to 98° C. Where necessary, a known catalyst such as dibutyltin laurate and dioctyltin laurate can be used.

When the particle distribution of the primary particles of toner particles is wide and the adjustment of the particle diameter distribution is not carried out in the washing and drying processes, the particles in the emulsion may be classified. The particles can be classified by removing fine particle fractions using a cyclone, decanter or centrifugal separator in a liquid. Although the classification can be carried out on dried particles after drying, it is more preferred that the classification is carried out in a solution, from the viewpoint of efficiency of the process. The obtained irregular toner particles and coarse particles, as a result of the classification, are sent back to the kneading step so as to recycle. In this case, the fine particles or coarse particles may be in a wet condition.

The dispersing agent is preferably removed from the obtained dispersion, and more preferably removed at the same time of the classification.

The toner particles after drying can be mixed with finely-divided particles of various agents such as a mold release agent, a charge control agent, and a fluidity-imparting agent. By the application of mechanical impact to the thus obtained mixture of particles, the finely-divided particles of various agents can be fixed and deposited on the surface of the toner particles or uniformly blended with the toner particles on the surface thereof. Thus, the particles of various agents attached to the surface of the toner particles can be prevented from flaking off.

Specific methods for applying an impact force are, for example, a method in which the impact force is applied to the mixed particles by using a rotated impeller blade in high speed, a method in which the mixed particles are placed in high-speed flow so as to subject the mixed particles or complex particles to be in a collision course with a suitable collision board. Examples of apparatus therefore include angmill (available from Hosokawa Micron Corporation), a modified I-type mill (available from Nippon Pneumatic MFG., Co., Ltd.) which is reduced pulverizing air pressure, a hybridization system (available from Nara Machine Corporation), Kryptron System (available from Kawasaki Heavy Industries, Ltd.), and an automatic mortar.

The toner of the present invention can be used in combination with a magnetic carrier in a two-component developer. The amount of the toner in the developer is preferably from 1 part by weight to 10 parts by weight relative to 100 parts by weight of the carrier. Such magnetic carriers include, for example, conventional magnetic particles with a particle diameter of about 20 μm to about 200 μm, made of iron, ferrite, magnetite, and magnetic resins. Coating materials for use herein include, but are not limited to, amine resins such as urea-formaldehyde resins, melamine resins, benzoguanamine resins, urea resins, polyamide resins, and epoxy resins; polyvinyl and polyvinylidene resins such as acrylic resins, poly(methyl methacrylate) resins, polyacrylonitrile resins, poly(vinyl acetate) resins, poly(vinyl alcohol) resins, poly(vinyl butyral) resins, polystyrene resins, styrene-acrylic copolymer resins, and other styrenic resins; poly(vinyl chloride) and other halogenated olefin resins; poly(ethylene terephthalate) resins, poly(butylene terephthalate) resins, and other polyester resins; polycarbonate resins; polyethylene resins; poly(vinyl fluoride) resins, poly(vinylidene fluoride) resins, polytrifluoroethylene resins, polyhexafluoropropylene resins, copolymers of vinylidene fluoride and acrylic monomer, vinylidene fluoride-vinyl fluoride copolymers, terpolymers of tetrafluoroethylene, vinylidene fluoride, and a non-fluorinated monomer, and other fluoroterpolymers; and silicone resins. The resin for use in the coating material may further comprise a conductive powder according to necessity. Such conductive powders include, for example, powders of metals, carbon black, titanium oxide, tin oxide, and zinc oxide. These conductive powders preferably have an average particle diameter of 1 μm or less. If the average particle diameter exceeds 1 μm, the electric resistance of the developer may not sufficiently be controlled.

The toner of the present invention can also be used as a one-component magnetic or non-magnetic toner without using a carrier.

Amorphous Silicon Photoconductor

An amorphous silicon photoconductor can be used as an electrophotographic photoconductor in the image forming method of the present invention. The amorphous silicon photoconductor (hereinafter referred to as a-Si photoconductor) has a substrate and a photoconductive layer formed of a-Si. The photoconductive layer may be formed on the substrate by heating a substrate to a temperature of from 50° C. to 400° C., and forming a photoconductive layer made of a-Si according to a film forming procedure such as vacuum deposition, sputtering, ion-plating, thermal CVD, optical CVD or plasma CVD. Of these, preferable procedure is plasma CVD in which raw material gas is decomposed by glow discharge of direct current, high frequency or microwave, and then a-Si is deposited on the substrate to form an a-Si film.

Figure 2A:
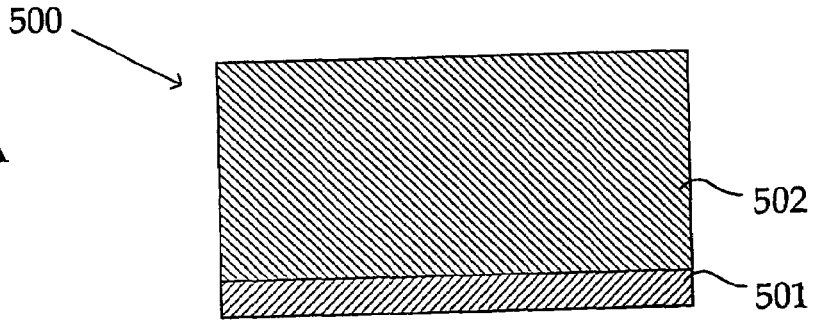
FIGS. 2A, 2B, 2C and 2D are diagrams explaining one example of a layer-structure of a-Si photoconductor.
Figure 2B:
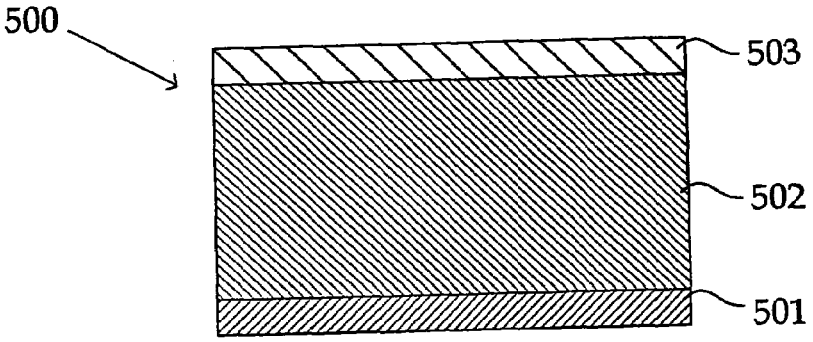
Figure 2C:
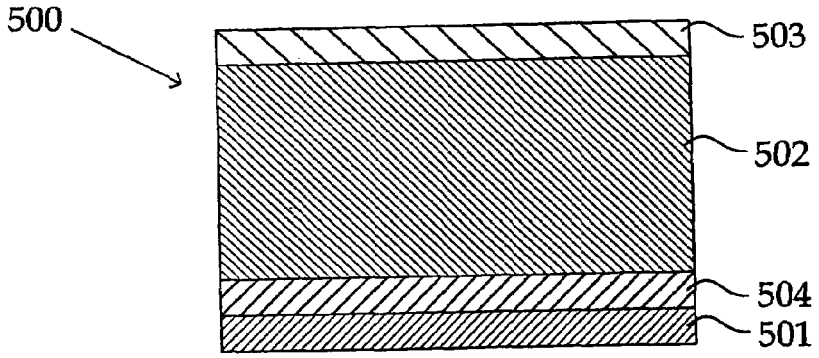
Figure 2D:
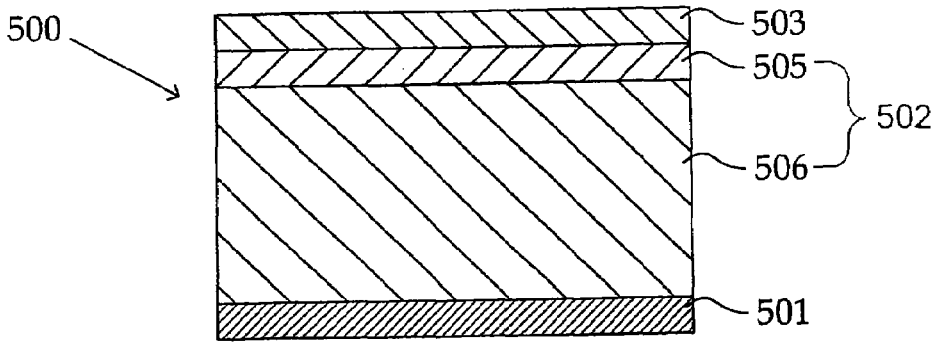

Examples of the layer structure of the amorphous silicon photoconductor are as follows. FIGS. 2A, 2B, 2C and 2D are schematic diagrams explaining the layer structure of the amorphous silicon photoconductor. With reference to FIG. 2A, an electrophotographic photoconductor 500 has a substrate 501 and a photoconductive layer 502 on the substrate 501. The photoconductive layer 502 is formed of a-Si: H, X, and exhibits photoconductivity. With reference to FIG. 2B, an electrophotographic photoconductor 500 has a substrate 501, a photoconductive layer 502 formed of a-Si: H, X and an amorphous silicon surface layer 503 arranged on the substrate 501. With reference to FIG. 2C, an electrophotographic photoconductor 500 has a substrate 501, and on the substrate 501, a photoconductive layer 502 formed of a-Si: H, X, an amorphous silicon surface layer 503 and an amorphous silicon charge injection inhibiting layer 504. With reference to FIG. 2D, an electrophotographic photoconductor 500 has a substrate 501 and a photoconductive layer 502 on the substrate 501. The photoconductive layer 502 comprises a charge generation layer formed of a-Si: H, X 505 and a charge transport layer 506. The electrophotographic photoconductor 500 further has an amorphous silicon surface layer 503 on the photoconductive layer 502.

The substrate of the photoconductor may be electrically conductive or insulative. Examples of the conductive substrate include metals such as Al, Cr, Mo, Au, In, Nb, Te, V, Ti, Pt, Pd and Fe, and alloys thereof such as stainless steel. An insulative substrate in which at least a surface facing to a photoconductive layer is treated to yield conductivity can also be used as the substrate. Examples of such insulative substrates are a film or sheet of a synthetic resin such as a polyester, polyethylene, polycarbonate, cellulose acetate, polypropylene, polyvinyl chloride, polystyrene or polyamide; as well as glass or ceramic.

The shape of the substrate may be cylindrical, plate, or endless belt, which has a smooth or irregular surface. The thickness of thereof can be adjusted so as to form a predetermined photoconductor. If the photoconductor must be flexible, the substrate can be as thinner as possible within ranges efficiently functioning as a substrate. The thickness of the substrate is generally 10 μm or more from the viewpoints of, for example, manufacture, handling, and mechanical strength.

In the photoconductor for use in the present invention, it is effective to dispose a charge injection inhibiting layer between the conductive substrate and the photoconductive layer (FIG. 2C) so as to inhibit a charge injection from the conductive substrate. The charge injection inhibiting layer has a polarity dependency. Namely, when charges of a specific polarity are applied to a free surface of the photoconductor, the charge injection inhibiting layer functions so as to inhibit a current injection from the conductive substrate to the photoconductive layer, and when charges of the opposite polarity are applied, the charge injection inhibiting layer does not function. In order to attain such function, the charge injection inhibiting layer contains relatively larger amounts of atoms which control a conductivity, compared with the photoconductive layer.

The thickness of the charge injection inhibiting layer is preferably from about 0.1 μm to about 5 μm, more preferably 0.3 μm to 4 μm, and furthermore preferable 0.5 μm to 3 μm for desired electrophotographic properties and better economical efficiency.

The photoconductive layer 502 may be disposed above an undercoat according to necessity. The thickness of the photoconductive layer 502 is not particularly limited, as long as desired electrophotographic properties and high cost efficiency are obtained. The thickness is preferably from about 1 μm to about 100 μm, more preferably 20 μm to 50 μm, and furthermore preferably 23 μm to 45 μm.

When the photoconductive layer is divided by its functions into plural layers, the charge transport layer mainly functions to transport currents. The charge transport layer comprises at least silicon atoms, carbon atoms and fluorine atoms as its essential components. If needed, the charge transport layer may further comprise hydrogen atoms and oxygen atoms so that the charge transport layer is formed of a-SiC(H,F,O). Such a charge transport layer exhibits desirable photoconductivity, especially charge holding property, charge generating property, and charge transporting property. It is particularly preferable that the charge transport layer contains an oxygen atom.

The thickness of the charge transport layer is suitably set so as to yield desirable electrophotographic properties and cost efficiency. The thickness thereof is preferably from about 5 μm to about 50 μm, more preferably 10 μm to 40 μm, and most preferably 20 μm to 30 μm.

When the photoconductive layers are divided by its functions into plural layers, the charge generation layer mainly functions to generate charges. The charge generation layer contains at least silicon atoms as an essential component and does not substantially contain a carbon atom. If needed, the charge generation layer may further comprise hydrogen atoms so that the charge generation layer is formed of a-Si: H. Such a charge generation layer exhibits desirable photoconductivity, especially charge generating property and charge transporting property.

The thickness of the charge generation layer is suitably set so as to yield desirable electrophotographic properties and cost efficiency. The thickness thereof is preferably from about 0.5 μm to about 15 μm, more preferably 1 μm to 10 μm, and most preferably 1 μm to 5 μm.

The amorphous silicon photoconductor for use in the present invention may further have a surface layer disposed on the photoconductive layer on the substrate. The surface layer is preferably an amorphous silicon layer. The surface layer has a free surface so that desirable properties such as moisture resistance, usability in continuous repeated use, electric strength, stability in operating environment, and durability.

The thickness of the surface layer is generally from about 0.01 μm to about 3 μm, preferably 0.05 μm to 2 μm, and more preferably 0.1 μm to 1 μm. If the thickness is less than about 0.01 μm, the surface layer may be worn out due to, for example, friction during usage of the photoconductor. If it exceeds about 3 μm, electrophotographic properties are impaired, and, for example, a residual charge increases.

Application of Alternating Field

In the image forming method of the present invention, an alternating field is preferably applied when a latent electrostatic image on the photoconductor is developed using a toner.

Figure 3:
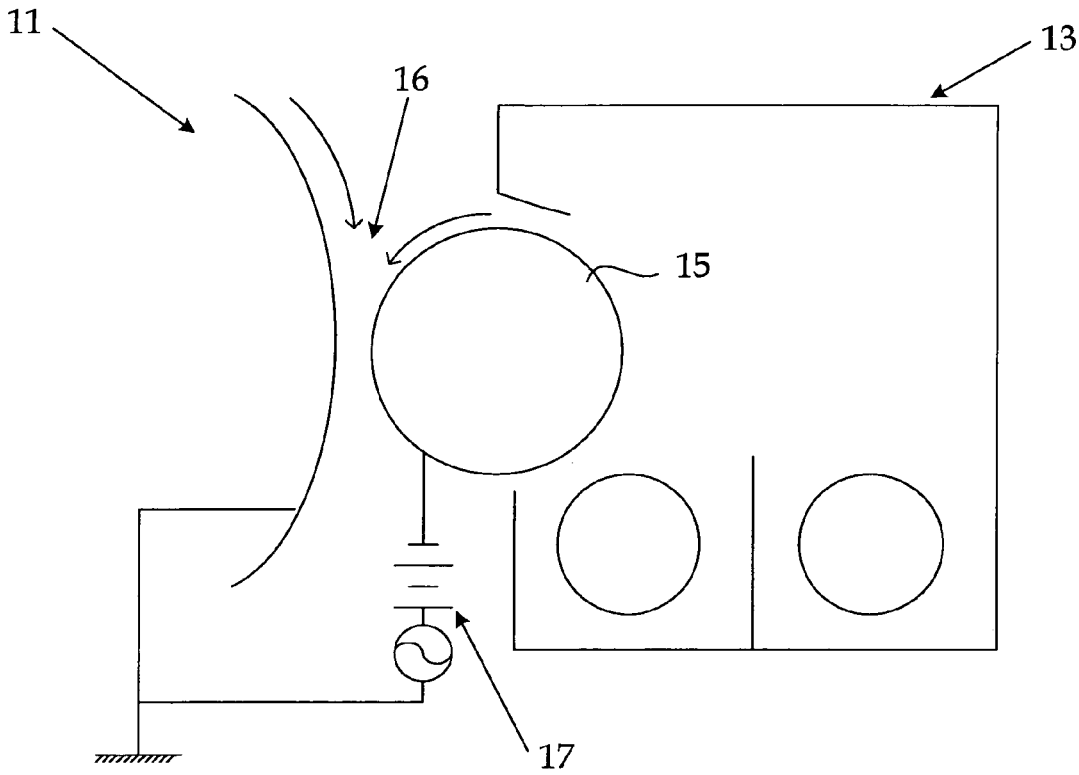
FIG. 3 is a diagram explaining one example of an interchange field application.

In an image developing device 13 shown in FIG. 3, a power supply 17 applies a vibration bias voltage as developing bias, in which a direct-current voltage and an alternating voltage are superimposed, to a developing sleeve 15 during developing. The potential of background part and the potential of image part are positioned between the maximum and the minimum of the vibration bias potential. This forms an alternating field, whose direction alternately changes, at developing region 16. A toner and a carrier in the developer are intensively vibrated in this alternating field, so that the toner overshoots the electrostatic force of constraint from the developing sleeve 15 and the carrier, and leaps to the photoconductor 11. The toner is then attached to the photoconductor 11 in accordance with a latent electrostatic image thereon.

The difference between the maximum and the minimum of the vibration bias voltage (peak-to-peak voltage) is preferably from 0.5 kV to 5 kV, and the frequency is preferably from 1 kHz to 10 kHz. The waveform of the vibration bias voltage may be a rectangular wave, a sine wave, or a triangular wave. The direct-current voltage of the vibration bias voltage is in a range between the potential at the background and the potential at the image as mentioned above, and is preferable set closer to the potential at the background from viewpoints of inhibiting a toner deposition on the background.

When the vibration bias voltage is a rectangular wave, a duty ratio is preferably 50% or less. The duty ratio is a ratio of time when the toner leaps to the photoconductor during a cycle of the vibration bias. Thus, the difference between the peak time value when the toner leaps to the photoconductor and the time average value of bias can become very large. Consequently, the movement of the toner becomes further activated hence the toner is accurately attached to the potential distribution of the latent electrostatic image to avoid rough deposits and to improve an image resolution. In addition, the difference between the time peak value when the carrier having an opposite polarity of current to the toner leaps to the photoconductor and the time average value of bias can be decreased. The movement of the carrier can be restrained to thereby significantly reduce the possibility of the carrier deposition on the background.

Voltage Application on Charger

Roller Charger

Figure 4:
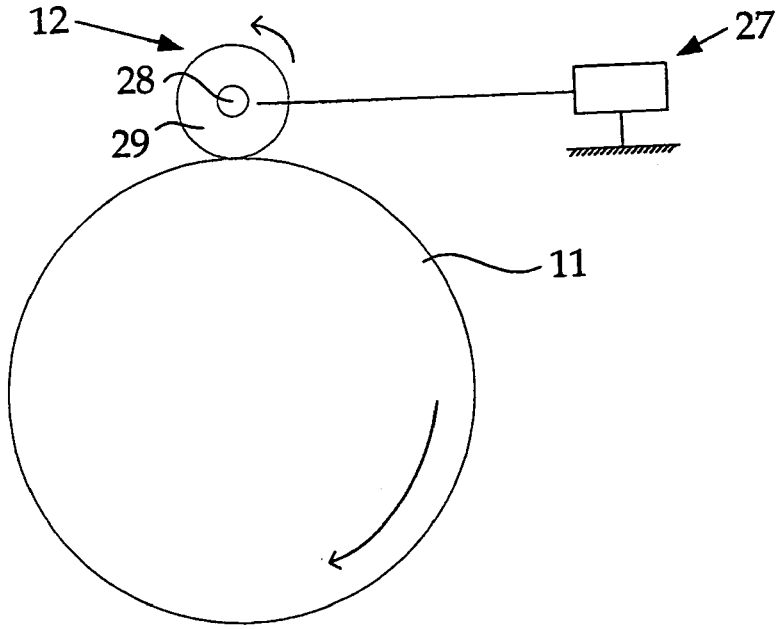
FIG. 4 is a diagram illustrating one example of a roller charger.

FIG. 4 is a schematic diagram of an example of the image-forming apparatus having a contact charger. The photoconductor 11 to be charged as an image bearing member is rotated at a predetermined speed (process speed) in the direction shown with the arrow in the figure. The charging roller 12, which is brought into contact with the photoconductor 11, contains a core rod 28 and a conductive rubber layer 29 concentrically arranged on the core rod. The both ends of the core rod 28 are supported with bearings (not shown) so as to allow the charging roller 12 to rotate freely, and the charging roller 12 is pressed to the photoconductor 11 at a predetermined pressure by pressurizing means (not shown). The charging roller 12 in this figure therefore rotates along with the rotation of the photoconductor 11. The charging roller 12 is generally formed with a diameter of 16 mm in which a core rod 28 having a diameter of 9 mm is coated with a rubber layer 29 having a moderate resistance of approximately 100,000 Ωcm.

The power supply 27 shown in the figure is electrically connected to the core rod and supplies a predetermined bias to the core rod. Thus, the surface of the photoconductor 11 is uniformly charged at a predetermined polarity and potential.

The shape of a charger for use in the present invention is not specifically limited and can for example be, apart from a roller, a magnetic brush or a fur brush. It can be suitably selected according to a specification or configuration of an image-forming apparatus. When a magnetic brush is used as a charger, the magnetic brush contains an electrostatic charger formed of various ferrite particles such as. Zn—Cu ferrite, a non-magnetic conductive sleeve to support the electrostatic charger, and a magnetic roller contained in the non-magnetic conductive sleeve. When a fur brush is used as a charger, a material of the fur brush is, for example, a fur that becomes conductive by treatment with, for example, carbon, copper sulfide, a metal or a metal oxide, and the fur is coiled or mounted to a metal or another core rod which becomes conductive by treatment.

Fur Brush Charger

Figure 5:
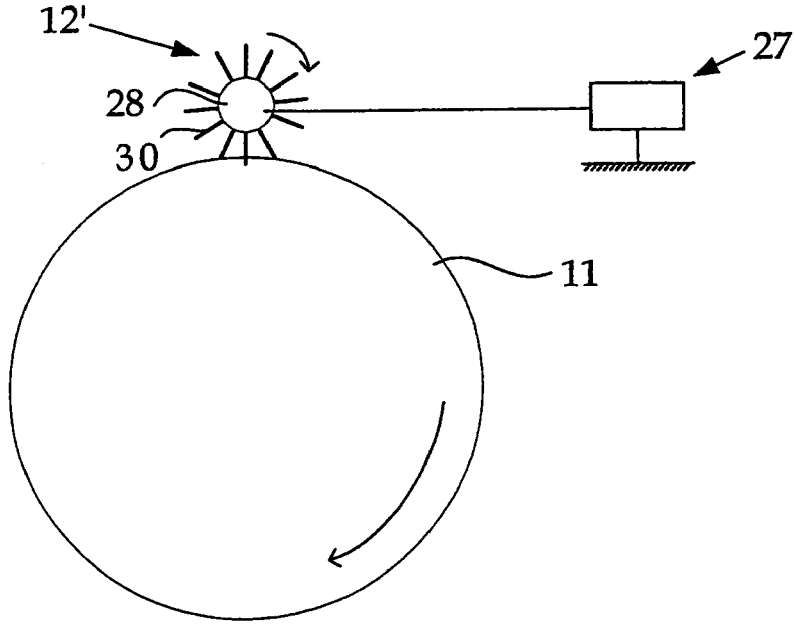
FIG. 5 is a diagram illustrating one example of a brush charger.

FIG. 5 is a schematic diagram of another example of the image-forming apparatus having a contact charger. The photoconductor 11 as an object to be charged and image bearing member, is rotated at a predetermined speed (process speed) in the direction shown with the arrow in the figure. The brush roller 12' having a fur brush or magnetic brush is brought in contact with the photoconductor 11, with a predetermined nip width and at a predetermined pressure with respect to elasticity of the brush part.

The fur brush roller 12' as the contact charger for use in the present invention has an outside diameter of 14 mm and a longitudinal length of 250 mm. In this fur brush, a tape with a pile of conductive rayon fiber REC-B (trade name, available from Unitika Ltd.), as a brush part 30, is spirally coiled around a metal core rod 28 having a diameter of 6 mm, which is also functioned as an electrode. The brush of the brush part 30 is of 300 denier/50 filament, and a density of 155 fibers per 1 square millimeter. This rolled brush is once inserted into a pipe having an internal diameter of 12 mm with rotating in a certain direction, and is concentrically arranged relative to the pipe. Thereafter, the rolled brush in the pipe is left in an atmosphere of high humidity and high temperature so as to twist the fibers of the fur.

The resistance of the fur brush roller 12' is $1\times10^5$ Ω at an applied voltage of 100 V. This resistance is calculated from the current obtained when the fur brush roller 12' is in contact with a metal drum having a diameter of 30 mm with a nip width of 3 mm, and a voltage of 100 V is applied thereon.

The resistance of the fur brush roller 12' should be $10^4$ Ω or more in order to prevent image imperfection caused by an insufficient charge at the charging nip part when the photoconductor to be charged happens to have low electric strength defects such as pin holes thereon and an excessive leak current therefore flows into the defects. It should be $10^7$ Ω or less in order to sufficiently charge the surface of the photoconductor.

Examples of the material of the fur include, in addition to REC-B (trade name, available from Unitika Ltd.), REC-C, REC-M1, REC-M10 (trade names, available from Unitika Ltd.), SA-7 (trade name, available from Toray Industries, Inc.), Thunderon (trade name, available from Nihon Sanmo Dyeing Co., Ltd.), Belltron (trade name, available from Kanebo Gohsen, Ltd.), Clacarbo (trade name, available from Kuraray Co., Ltd.), a rayon fiber containing dispersed carbon, and Roval (trade name, available from Mitsubishi Rayon Co., Ltd.). The brush is of preferably 3 to 10 denier per fiber, 10 to 100 filaments per bundle, and 80 to 600 fibers per square millimeter. The length of the fur is preferably 1 mm to 10 mm.

The fur brush roller 12' is rotated in the opposite (counter) direction to the rotation direction of the photoconductor 11 at a predetermined peripheral speed (surface speed) and comes into contact with the photoconductor 11 with a speed difference. The power supply 27 applies a predetermined charging voltage to the fur brush roller 12' so that the surface of the photoconductor 11 is uniformly charged at a predetermined polarity and potential. In contact charge of the photoconductor 11 by the fur brush roller 12', charges are mainly directly injected and the surface of the photoconductor 11 is charged at the substantially equal voltage to the applied charging voltage to the fur brush roller 12'.

The magnetic brush as a contact charger for use in the present embodiment is formed of magnetic particles. In the magnetic particles, Z-Cu ferrite particles having an average particle diameter of 25 μm and Z-Cu ferrite particles having an average particle diameter of 10 μm are mixed in a weight ratio of 1:0.05 so as to form ferrite particles having peaks at each average particle diameter, and a total average particle diameter of 25 μm. The ferrite particles are coated with a resin layer having a moderate resistance so as to form the magnetic particles. The contact charger comprises the above-mentioned coated magnetic particles, a non-magnetic conductive sleeve which supports the coated magnetic particles, and a magnet roller which is included in the non-magnetic conductive sleeve. The coated magnetic particles are disposed on the sleeve with a thickness of 1 mm so as to form a charging nip 5 mm wide with the photoconductor 11. The gap between the non-magnetic conductive sleeve and the photoconductor 11 is adjusted to approximately 500 μm. The magnetic roller is rotated so as to rotate the non-magnetic conductive sleeve at twice in speed relative to the peripheral speed of the surface of the photoconductor 11, and in the opposite direction to the photoconductor 11. Thus, the magnetic brush is uniformly in contact with the photoconductor 11.

Figure 6:
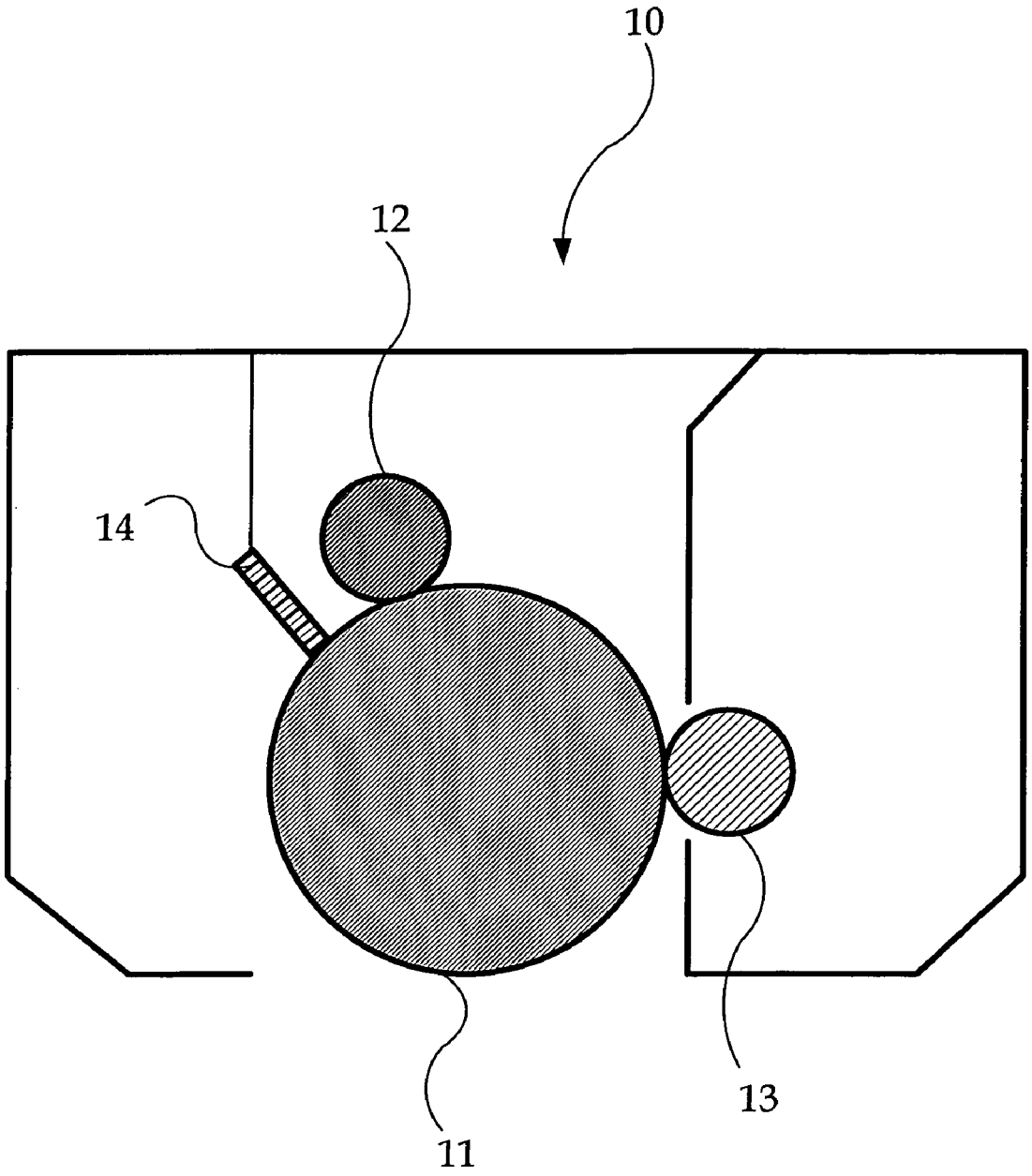
FIG. 6 is a schematic diagram illustrating one example of a process-cartridge.

FIG. 6 is a schematic diagram of an image forming apparatus according to the present invention which has a process cartridge 10 containing a toner. The process cartridge for use herein comprises two or more of components such as a photoconductor 11, charging unit (charger) 12, developing unit 13 and cleaning unit 14. These components are integrated as the process cartridge 10 which is detachable from a main body of an image forming apparatus such as a copier or a printer.

In the image-forming apparatus of the present invention which has the process cartridge 10, the photoconductor 11 is rotated at predetermined peripheral speed. During the cycle of a rotation of the photoconductor 11, the charger 12 uniformly charges the photoconductor 11 at predetermined positive or negative potential, thereafter an image exposing system of, for example, slit exposure or laser beam scanning exposure applies light imagewise to the charged photoconductor 11. Thus, latent electrostatic images are sequentially formed on the circumferential surface of the photoconductor 11. The image developer develops the formed latent electrostatic images with the toner so as to form toner images, and then the transfer means sequentially transfer the toner images onto a transfer medium which is fed from a paper feeder to between the photoconductor 11 and the transfer means synchronously with the rotation of the photoconductor 11. The transfer medium bearing the transferred toner images is separated from the photoconductor 11, and is introduced to the fixer. The fixer fixes the transferred images onto the transfer medium so as to form a reproduction (copy) and then the copy is sent out from the apparatus, i.e., printed out. After transferring the toner image, cleaner removes the remained toner on the surface of the photoconductor 11 so as to clean the surface. The charge of the photoconductor is then then eliminated for another image formation. Thus, latent electrostatic images are sequentially formed on the circumferential surface of the photoconductor. The image developer develops the formed latent electrostatic images with the toner so as to form toner images, and then the transfer means sequentially transfer the toner images onto a transfer medium which is fed from a paper feeder to between the photoconductor and the transfer means synchronously with the rotation of the photoconductor. The transfer medium bearing the transferred toner images is separated from the photoconductor, and is introduced to the fixer. The fixer fixes the transferred images onto the transfer medium so as to form a reproduction (copy) and then the copy is sent out from the apparatus, i.e., printed out. After transferring the toner image, cleaner removes the remained toner on the surface of the photoconductor so as to clean the surface. The charge of the photoconductor is then eliminated for another image formation.

The present invention will be illustrated in further detail with reference to several examples below, which are never intended to limit the scope of the present invention. All parts are by weight. Toners used in the examples are shown in Table 1.

PREPARATION EXAMPLE 1

Preparation of Organic

Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd.), 83 parts of styrene, 83 parts of methacrylic acid, 110 parts of butyl acrylate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Fine Particle Dispersion 1] of a vinyl resin (a copolymer of styrene-methacrylic acid-butyl acrylate-sodium salt of sulfuric acid ester of ethylene oxide adduct of methacrylic acid). Fine Particle Dispersion 1 had a weight-average particle diameter of 105 nm as determined with a laser diffraction-scattering size distribution analyzer LA-920 (trade name, available from Horiba, Ltd.). Part of Fine Particle Dispersion 1 was dried to isolate a resin component. The resin component had a Tg of 59° C. and a weight-average molecular weight of $15\times10^4$.

PREPARATION EXAMPLE 2

Preparation of Aqueous Phase

Aqueous Phase 1 was prepared as an opaque liquid by blending and stirring 990 parts of water, 99 parts of Fine Particle Dispersion 1, 35 parts of a 48.5% aqueous solution of sodium dodecyl diphenyl ether disulfonate ELEMINOL MON-7 (trade name, available from Sanyo Chemical Industries, Ltd.), and 70 parts of ethyl acetate.

PREPARATION EXAMPLE 3

Preparation of Low-molecular Weight Polyester

In a reactor equipped with a condenser, a stirrer and a nitrogen gas feed tube were placed 229 parts of an ethylene oxide (2 mole) adduct of bisphenol A, 529 parts of a propylene oxide (3 mole) adduct of bisphenol A, 208 parts of terephthalic acid, 46 parts of adipic acid, and 2 parts of dibutyltin oxide. The mixture was reacted at 230° C. at normal atmospheric pressure for 8 hours and was further reacted at a reduced pressure of 10 mmHg to 15 mmHg for 5 hours. The reaction mixture was further treated with 44 parts of trimellitic anhydride at 180° C. at normal atmospheric pressure for 1.8 hours and thereby yielded Low-molecular Weight Polyester 1. Low-molecular Weight Polyester 1 had a number-average molecular weight of 2,500, a weight-average molecular weight of 6700, a peak molecular weight of 5,000, a Tg of 43° C., and an acid value of 25.

PREPARATION EXAMPLE 4

Preparation of Prepolymer

In a reactor equipped with a condenser, a stirrer and a nitrogen gas feed tube were placed 682 parts of ethylene oxide (2 mole) adduct of bisphenol A, 81 parts of a propylene oxide (2 mole) adduct of bisphenol A, 283 parts of terephthalic acid, 22 parts of trimellitic anhydride and 2 parts of dibutyltin oxide. The mixture was reacted at 230° C. at normal atmospheric pressure for 8 hours, was further reacted under a reduced pressure of 10 mmHg to 15 mmHg for 5 hours and thereby yielded Intermediate Polyester 1 having a number-average molecular weight of 2100, a weight-average molecular weight of 9500, a Tg of 55° C., an acid value of 0.5 and a hydroxyl value of 51.

In a reactor equipped with a condenser, a stirrer and a nitrogen gas feed tube were placed 410 parts of Intermediate Polyester 1, 89 parts of isophorone diisocyanate, and 500 parts of ethyl acetate, followed by reaction at 100° C. for 5 hours to yield Prepolymer 1 having a free isocyanate content of 1.53% by weight.

PREPARATION EXAMPLE 5

Preparation of Ketimine Compound

In a reactor equipped with a stirring rod and a thermometer were placed 170 parts of isophoronediamine and 75 parts of methyl ethyl ketone, followed by reaction at 50° C. for 5 hours to yield Ketimine Compound 1 having an amine equivalent of 418.

PREPARATION EXAMPLE 6

Preparation of Master Batch

A total of 1200 parts of water, 800 parts of carbon black Printex 35 (trade name, available from Degussa AG DBP oil absorbance: 42 ml/100-mg; pH: 9.5), and 1200 parts of a polyester resin was mixed in a Mitsui HENSCHEL MIXER (trade name, available from Mitsui Mining Co., Ltd.). The mixture was kneaded at 150° C. for 30 minutes in a two-roll mill, was cold-rolled, was pulverized in a pulverizer and thereby yielded Master Batch 1.

PREPARATION EXAMPLE 7

Preparation of Oil Phase

In a reactor equipped with a stirring rod and a thermometer were placed 378 parts of Low-molecular Weight Polyester 1, 110 parts of carnauba wax, 22 parts of a zinc complex of salicylic acid Bontron E-84 (trade name, available from Orient Chemical Industries, Ltd.) as a charge control agent (CCA), and 947 parts of ethyl acetate. The mixture was heated at 80° C. for 5 hours with stirring and was then cooled to 30° C. over 1 hour. The mixture was further treated with 500 parts of Master Batch 1 and 500 parts of ethyl acetate with stirring for 1 hour and thereby yielded Material Solution 1.

Next, 1324 parts of Material Solution 1 was placed in a vessel, and the carbon black and wax components therein were dispersed using a bead mill (ULTRAVISCO-MILL available from Aimex Co., Ltd.) at a liquid feeding speed of 1 kg/hr, a disc peripheral speed of 6 m/sec., using zirconia beads 0.5 mm in diameter filled 80% by volume. The dispersing procedure was repeated a total of three times. The dispersion was further treated with 1324 parts of a 65% ethyl acetate solution of Low-molecular Weight Polyester 1, and the mixture was dispersed under the above conditions, except that the dispersion procedure was performed once, to yield Pigment-wax Dispersion 1. Pigment-wax Dispersion 1 had a solid content of 50% as determined by heating the dispersion at 130° C. for 30 minutes.

EXAMPLE 1

Emulsification and Solvent Removal

In a vessel were placed 749 parts of Pigment-wax Dispersion 1, 115 parts of Prepolymer 1, and 2.9 parts of Ketimine Compound 1, and the mixture was mixed at 5,000 rpm for 1 minute in a T.K. HOMO MIXER (trade name, available from Tokushu Kika Kogyo Co., Ltd.). Next, the mixture was treated with 1200 parts of Aqueous Phase 1 by dispersing at 12,500 rpm for 30 minutes in a T.K. HOMO MIXER and thereby yielded Emulsified Slurry 1.

In a vessel equipped with a stirrer and a thermometer was placed Emulsified Slurry 1 and was heated at 35° C. for 7 hours to remove the solvents therefrom. The slurry was aged at 45° C. for 4 hours and thereby yielded Dispersed Slurry 1.

A total of 100 parts of Dispersed Slurry 1 was filtered under a reduced pressure and was washed by the following procedures.

(1) The filtered cake and 100 parts of deionized water were mixed in a T.K. HOMO MIXER at 12,000 rpm for 10 minutes, and the mixture was filtered.

(2) The filtered cake prepared in (1) and 100 parts of a 10% aqueous solution of sodium hydroxide were mixed in a T.K. HOMO MIXER at 12,000 rpm for 30 minutes, and the mixture was filtered under a reduced pressure.

(3) The filtered cake prepared in (2) and 100 parts of a 10% hydrochloric acid were mixed in a T.K. HOMO MIXER at 12,000 rpm for 10 minutes, and the mixture was filtered.

(4) The filtered cake prepared in (3) and 300 parts of ion-exchanged water were mixed in a T.K. HOMO MIXER at 12,000 rpm for 10 minutes, and the mixture was filtered, wherein this washing procedure was further repeated twice to yield Filtered Cake 1.

Filtered Cake 1 was dried at 45° C. for 48 hours in a circulating air dryer, was sieved with a 75-μm mesh sieve and thereby yielded Toner Matrix 1. Toner Matrix 1 had a weight-average particle diameter of 4.8 μm and a number-average particle diameter of 3.9 μm.

Toner Matrix 1 (100 parts) and hydrophobic titanium oxide (0.7 part) were mixed in a HENSCHEL MIXER and thereby yielded Toner 1.

PREPARATION EXAMPLE 8

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd.), 80 parts of styrene, 83 parts of methacrylic acid, 110 parts of butyl acrylate, 12 parts of butyl thioglycolate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Fine Particle Dispersion 2] of a vinyl resin (a copolymer of styrene-methacrylic acid-butyl acrylate-sodium salt of sulfuric acid ester of ethylene oxide adduct of methacrylic acid). Fine Particle Dispersion 2 had a weight-average particle diameter of 120 nm as determined with a laser diffraction-scattering size distribution analyzer LA-920 (trade name, available from Horiba, Ltd.). Part of Fine Particle Dispersion 2 was dried to isolate a resin component. The resin component had a Tg of 42° C. and a weight-average molecular weight of $3\times10^4$.

EXAMPLE 2

Toner 2 was prepared by the procedure of Example 1, except that Fine Particle Dispersion 2 was used instead of Fine Particle Dispersion 1.

PREPARATION EXAMPLE 9

Preparation of Organic Fine Particle Dispersion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd.), 103 parts of styrene, 83 parts of methacrylic acid, 90 parts of butyl acrylate, 12 parts of butyl thioglycolate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Fine Particle Dispersion 3] of a vinyl resin (a copolymer of styrene-methacrylic acid-butyl acrylate-sodium salt of sulfuric acid ester of ethylene oxide adduct of methacrylic acid). Fine Particle Dispersion 3 had a weight-average particle diameter of 110 nm as determined with a laser diffraction-scattering size distribution analyzer LA-920 (trade name, available from Horiba, Ltd.). Part of Fine Particle Dispersion 3 was dried to isolate a resin component. The resin component had a Tg of 78° C. and a weight-average molecular weight of $2.5\times10^4$.

EXAMPLE 3

Toner 3 was prepared by the procedure of Example 1, except that Fine Particle Dispersion 3 was used instead of Fine Particle Dispersion 1.

PREPARATION EXAMPLE 10

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd.), 78 parts of styrene, 83 parts of methacrylic acid, 115 parts of butyl acrylate, 2 parts of butyl thioglycolate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Fine Particle Dispersion 4] of a vinyl resin (a copolymer of styrene-methacrylic acid-butyl acrylate-sodium salt of sulfuric acid ester of ethylene oxide adduct of methacrylic acid). Fine Particle Dispersion 4 had a weight-average particle diameter of 115 nm as determined with a laser diffraction-scattering size distribution analyzer LA-920 (trade name, available from Horiba, Ltd.). Part of Fine Particle Dispersion 4 was dried to isolate a resin component. The resin component had a Tg of 51° C. and a weight-average molecular weight of $10\times10^4$.

EXAMPLE 4

Toner 4 was prepared by the procedure of Example 1, except that Fine Particle Dispersion 4 was used instead of Fine Particle Dispersion 1 and that hydrophobic silica was used as an external additive instead of hydrophobic titanium oxide.

PREPARATION EXAMPLE 11

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd.), 68 parts of styrene, 93 parts of methacrylic acid, 115 parts of butyl acrylate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Fine Particle Dispersion 5] of a vinyl resin (a copolymer of styrene-methacrylic acid-butyl acrylate-sodium salt of sulfuric acid ester of ethylene oxide adduct of methacrylic acid). Fine Particle Dispersion 5 had a weight-average particle diameter of 90 nm as determined with a laser diffraction-scattering size distribution analyzer LA-920 (trade name, available from Horiba, Ltd.). Part of Fine Particle Dispersion 5 was dried to isolate a resin component. The resin component had a Tg of 56° C. and a weight-average molecular weight of $15\times10^4$.

PREPARATION EXAMPLE 7-2

Preparation of Oil Phase

Material Solution 2 was prepared by the procedure of Preparation Example 7, except that 22 parts of the metal complex of salicylic acid Bontron E-84 (trade name, available from Orient Chemical Industries, Ltd.) as the charge control agent were not used.

Next, 1324 parts of Material Solution 2 was placed in a vessel, and the carbon black and wax components therein were dispersed using a bead mill (ULTRAVISCO-MILL available from Aimex Co., Ltd.) at a liquid feeding speed of 1 kg/hr, a disc peripheral speed of 6 m/sec., using zirconia beads 0.5 mm in diameter filled 80% by volume. The dispersing procedure was repeated a total of three times. The dispersion was further treated with 1324 parts of a 65% ethyl acetate solution of Low-molecular Weight Polyester 1, and the mixture was dispersed under the above conditions except that the dispersion procedure was performed once to yield Pigment-wax Dispersion 2. Pigment-wax Dispersion 2 had a solid content of 50% as determined by heating the dispersion at 130° C. for 30 minutes.

EXAMPLE 5

Toner Matrix 5 was prepared by the procedure of Example 1, except that Fine Particle Dispersion 5 and Pigment-wax Dispersion 2 were used instead of Fine Particle Dispersion 1 and Pigment-wax Dispersion 1, respectively.

Next, 100 parts of Toner Matrix 5 and 0.5 part of a metal complex of salicylic acid Bontron E-84 (trade name, available from Orient Chemical Industries, Ltd.) as a charge control agent were mixed at 1,000 rpm in a HENSCHEL MIXER and was further mixed at 6,000 rpm in a Q Mixer (available from Mitsui Mining Co., Ltd.) to thereby apply the charge control agent to the surface of the toner matrix.

Toner 5 was then prepared by the procedure of Example 1, except that the above-prepared article was used and that hydrophobic silica was used as an external additive instead of hydrophobic titanium oxide.

PREPARATION EXAMPLE 12

Preparation of Emulsified Slurry

In a vessel were placed 753 parts of Pigment-wax Dispersion 1, 154 parts of Prepolymer 1, and 3.8 parts of Ketimine Compound 1, and the mixture was mixed at 5,000 rpm for 1 minute in a T.K. HOMO MIXER (trade name, available from Tokushu Kika Kogyo Co., Ltd.). Next, the mixture was treated with 1200 parts of Aqueous Phase 1 by dispersing at 13,000 rpm for 20 minutes in a T.K. HOMO MIXER and thereby yielded Emulsified Slurry 6.

EXAMPLE 6

Toner 6 was prepared by the procedure of Example 1, except that Emulsified Slurry 6 was used instead of Emulsified Slurry 1 and that the sample was transferred to a T.K. HOMO MIXER on the way of removal of the solvents, was stirred therein at 12,500 rpm for 40 minutes and thereby yielded toner particles having spindle shapes.

PREPARATION EXAMPLE 13

Preparation of Low-molecular Weight Polyester

In a reactor equipped with a condenser tube, a stirrer and a nitrogen gas feed tube were placed 196 parts of a propylene oxide (2 mole) adduct of bisphenol A, 553 parts of an ethylene oxide (2 mole) adduct of bisphenol A, 210 parts of terephthalic acid, 79 parts of adipic acid, and 2 parts of dibutyltin oxide. The mixture was reacted at 230° C. at normal atmospheric pressure for 8 hours and was further reacted at a reduced pressure of 10 mmHg to 15 mmHg for 5 hours. The reaction mixture was further treated with 26 parts of trimellitic anhydride at 180° C. at normal atmospheric pressure for 2 hours and thereby yielded Low-molecular Weight Polyester 2.

Low-molecular Weight Polyester 2 had a number-average molecular weight of 2400, a weight-average molecular weight of 6200, a peak molecular weight of 5200, a Tg of 43° C., and an acid value of 15.

EXAMPLE 7

Toner 7 was prepared by the procedure of Example 5, except that Low-molecular Weight Polyester 2 was used instead of Low-molecular Weight Polyester 1, and that the sample was transferred into a T.K. HOMO MIXER on the way of removal of the solvents, was stirred therein at 13,000 rpm for 30 minutes and thereby yielded toner particles having spindle shapes.

PREPARATION EXAMPLE 14

Preparation of Aqueous Phase

Aqueous Phase 6 was prepared as an opaque liquid by blending and stirring 990 parts of water, 62 parts of Fine Particle Dispersion 1, 37 parts of a 48.5% aqueous solution of sodium dodecyl diphenyl ether disulfonate ELEMINOL MON-7 (trade name, available from Sanyo Chemical Industries, Ltd.), and 90 parts of ethyl acetate.

COMPARATIVE EXAMPLE 1

Toner 8 was prepared by the procedure of Example 1, except that Aqueous Phase 6 was used instead of Aqueous Phase 1.

PREPARATION EXAMPLE 15

Preparation of Aqueous Phase

Aqueous Phase 7 was prepared as an opaque liquid by blending and stirring 990 parts of water, 77 parts of Fine Particle Dispersion 1, 37 parts of a 48.5% aqueous solution of sodium dodecyl diphenyl ether disulfonate ELEMINOL MON-7 (trade name, available from Sanyo Chemical Industries, Ltd.), and 90 parts of ethyl acetate.

COMPARATIVE EXAMPLE 2

Toner 9 was prepared by the procedure of Example 1, except that Aqueous Phase 7 was used instead of Aqueous Phase 1.

PREPARATION EXAMPLE 16

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd.), 138 parts of styrene, 138 parts of methacrylic acid and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion

[Fine Particle Dispersion 6] of a vinyl resin (a copolymer of styrene-methacrylic acid-butyl acrylate-sodium salt of sulfuric acid ester of ethylene oxide adduct of methacrylic acid).

Fine Particle Dispersion 6 had a weight-average particle diameter of 140 nm as determined with a laser diffraction-scattering size distribution analyzer LA-920 (trade name, available from Horiba, Ltd.). Part of Fine Particle Dispersion 6 was dried to isolate a resin component. The resin component had a Tg of 152° C. and a weight-average molecular weight of $40\times10^4$.

COMPARATIVE EXAMPLE 3

Toner 10 was prepared by the procedure of Example 1, except that Fine Particle Dispersion 6 was used instead of Fine Particle Dispersion 1, and that the sample was transferred into a T.K. HOMO MIXER on the way of removal of the solvents, was stirred therein at 13,000 rpm for 30 minutes and thereby yielded toner particles having spindle shapes.

PREPARATION EXAMPLE 17

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd.), 63 parts of styrene, 83 parts of methacrylic acid, 130 parts of butyl acrylate, 12 parts of butyl thioglycolate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Fine Particle Dispersion 7] of a vinyl resin (a copolymer of styrene-methacrylic acid-butyl acrylate-sodium salt of sulfuric acid ester of ethylene oxide adduct of methacrylic acid).

Fine Particle Dispersion 7 had a weight-average particle diameter of 130 nm as determined with a laser diffraction-scattering size distribution analyzer LA-920 (trade name, available from Horiba, Ltd.). Part of Fine Particle Dispersion 7 was dried to isolate a resin component. The resin component had a Tg of 30° C. and a weight-average molecular weight of $5\times10^3$.

COMPARATIVE EXAMPLE 4

Toner Matrix 11 was prepared by the procedure of Example 1, except that Fine Particle Dispersion 7 was used instead of Fine Particle Dispersion 1.

Next, 100 parts of Toner Matrix 11 and 0.7 part of hydrophobic silica were mixed in a HENSCHEL MIXER and thereby yielded Toner 11.

| | |
|---|---|
| Binder Resin 1 (polyester resin; THF insoluble content 0% by weight) | 80 parts |
| Binder Resin 2 (urea-modified polyester resin; THF insoluble content 10% by weight) | 20 parts |
| Wax (carnauba wax) | 5 parts |

-continued

| | |
|---|---|
| Charge Control Agent (zinc complex of salicylic acid, Bontron E-84, from Orient Chemical Industries, Ltd.) | 2 parts |
| Coloring agent (carbon black Printex 35 from Degussa) | 10 parts |

The above materials were sufficiently mixed in a blender, and the mixture was melted and kneaded with a two-roll mill heated at 110° C. to 120° C. The kneaded product was left stand to cool, was roughly pulverized with a cutter mill, was further pulverized with a pulverizer of a jet mill breaker disc system, was subjected to air classification by action of a revolving current and thereby yielded toner particles. The toner particles were converted into spherical particles with a surface modifying apparatus NPK Surfusing System (trade name, available from Nippon Pneumatic Mfg. Co., Ltd.).

Next, 100 parts of the toner particles and 0.7 part of hydrophobic silica as an external additive were mixed in a HENSCHEL MIXER and thereby yielded Toner 12.

The THF-insoluble content was determined in the following manner.

(1) About 1.0 g (A) of a sample resin or toner was precisely weighed.

(2) The weighed sample was dissolved in about 50 g of THF, was subjected to centrifugal separation, was left to stand at 20° C. for 24 hours, and was filtrated using a glass filter to separate insoluble components.

The solvent was removed from the filtrate by drying in vacuum, and the residual amount (B) of the resin component was determined. The residual amount (B) was the amount of THF soluble components.

The content (%) of THF insoluble component was determined by calculation according to the following equation.

$$THF\text{-insoluble Content (\%)}=[(A-B)/A]\times100$$

The determined physical properties are shown in Table 1.

A developer was prepared by mixing 5% by weight of a toner and 95% by weight of a copper-zinc ferrite carrier having an average particle diameter of 40 μm and being coated with a silicone resin. An image was continuously printed out using the developer and a printer imagio Neo 450 (trade name, available from Ricoh Company Limited), and the properties of the developer were determined in the following manner and are shown in Table 2. The printer imagio Neo 450 can produce 45 copies of A4-sized sheets of paper per minute.

Determination of Properties

The following properties (1) to (3) were determined by the following methods using a belt fixing device as shown in FIG. 1 under the following conditions.

Belt tension: 1.5 kg/piece

Belt speed: 170 mm/sec

Fixing nip width: 10 mm

Fixing roller having a diameter of 38 mm and comprising foamed silicone having an Asker C hardness of about 30 degrees Press roller having a diameter of 50 mm and comprising a tubular iron rod having a thickness of 1 mm and a diameter of 48 mm, a perfluoro-alkoxyfluoro plastic (PFA) tube covering the rod and a silicon rubber layer having a thickness of 1 mm and having an Asker C hardness of about 75 degrees Heating roller comprising an aluminum tube having a thickness of 2 mm and having a diameter of 30 mm Fixing belt having a diameter of 60 mm and a width of 310 mm and comprising a base of nickel having a thickness of about 40 μm and a releasing layer of a silicone rubber having a thickness of about 150 μm (1) Lowest Fixing Temperature A copying test was carried out on Type 6200 Paper (trade name, available from Ricoh Company Limited) using a color copier Preter 550 (trade name, available from Ricoh Company Limited) having the belt fixing device. The lowest fixing temperature (° C.) was defined as a temperature of the fixing roller at which a survival rate of the image density was 70% or more after rubbing the fixed image with a pat.

(2) Hot Offset Non-occurring Temperature (HOT)

Monochromatic solid images of yellow, magenta, cyan and black, and intermediate-color solid images of red, blue and green were respectively reproduced using a modified color copier Preter 550 (trade name, available from Ricoh Company Limited) having the belt fixing device shown in FIG. 1 under the above conditions so as to develop the toner in an amount of 1.0±0.1 mg/cm$^2$. The temperature of the fixing belt was varied in this procedure, and occurrence of hot offset to the fixed image was visually observed. The hot offset non-occurring temperature was defined as a temperature of the fixing roller at which hot offset was not occurred.

(3) Glossiness

The glossiness of the above monochromatic solid image sample at a surface temperature of the fixing belt of 160° C. was determined at an incident angle of 60° using a glossmeter available from Nippon Denshoku Industries, Co., Ltd. The image has a higher gloss with an increasing glossiness determined. As a full-color copied image, a suitable glossiness is from about 10% to about 30%.

TABLE 1

| | Weight average particle diameter Dv μm | Number average particle diameter Dn μm | Dv/Dn | SF-1 | Particles with SF-1 of 160 or more (%) | Particles with SF-1 of 150 or more (%) | Particle Diameter of dispersed releasing agent μm | Dispersed particles of releasing agent |
|---|---|---|---|---|---|---|---|---|
| Example 1 | 4.8 | 3.9 | 1.23 | 107 | 1.2 | 4.3 | 0.88 | Concentrated in the vicinity of surface |
| Example 2 | 5.8 | 4.8 | 1.21 | 118 | 1.5 | 6.2 | 0.95 | Concentrated in the vicinity of surface |
| Example 3 | 6.8 | 6.3 | 1.08 | 125 | 1.5 | 7.7 | 0.94 | Concentrated in the vicinity of surface |
| Example 4 | 6.3 | 5.3 | 1.19 | 130 | 3.5 | 8.8 | 0.88 | Concentrated in the vicinity of surface |
| Example 5 | 3.5 | 3.0 | 1.17 | 116 | 0.4 | 3.2 | 0.96 | Concentrated in the vicinity of surface |
| Example 6 | 5.3 | 4.5 | 1.18 | 139 | 4.8 | 10.5 | 0.95 | Concentrated in the vicinity of surface |
| Example 7 | 3.9 | 3.4 | 1.15 | 155 | 8.7 | 28.5 | 0.76 | Concentrated in the vicinity of surface |
| Comp. Ex. 1 | 7.2 | 5.9 | 1.22 | 125 | 2.2 | 5.5 | 0.85 | Uniformly dispersed in the toner |
| Comp. Ex. 2 | 5.7 | 4.3 | 1.33 | 118 | 1.9 | 8.8 | 0.88 | Uniformly dispersed in the toner |
| Comp. Ex. 3 | 6.2 | 5.2 | 1.19 | 165 | 54.9 | 82.3 | 0.77 | Concentrated in the core of toner |
| Comp. Ex. 4 | 2.8 | 2.3 | 1.22 | 125 | 3.5 | 9.0 | 0.75 | Exposed from the surface |
| Comp. Ex. 5 | 6.5 | 4.8 | 1.35 | 120 | 3.2 | 7.8 | 0.65 | Exposed from the surface |

| | G' (80° C.) | G' (180° C.) | Maximum tan δ (80-130° C.) | Preparation process |
|---|---|---|---|---|
| Example 1 | $1.2 \times 10^6$ | $2.1 \times 10^3$ | 3.5 | Wet granulation |
| Example 2 | $1.3 \times 10^6$ | $2.2 \times 10^3$ | 3.6 | Wet granulation |
| Example 3 | $1.4 \times 10^6$ | $2.3 \times 10^3$ | 4.0 | Wet granulation |
| Example 4 | $1.1 \times 10^6$ | $2.1 \times 10^3$ | 3.2 | Wet granulation |
| Example 5 | $6.5 \times 10^5$ | $6.7 \times 10^2$ | 7.3 | Wet granulation |
| Example 6 | $4.5 \times 10^6$ | $3.3 \times 10^3$ | 2.2 | Wet granulation |
| Example 7 | $5.8 \times 10^7$ | $7.8 \times 10^3$ | 1.9 | Wet granulation |
| Comp. Ex. 1 | $1.1 \times 10^6$ | $2.5 \times 10^3$ | 3.1 | Wet granulation |
| Comp. Ex. 2 | $1.3 \times 10^6$ | $2.1 \times 10^3$ | 2.8 | Wet granulation |
| Comp. Ex. 3 | $1.0 \times 10^6$ | $2.0 \times 10^3$ | 4.5 | Wet granulation |
| Comp. Ex. 4 | $6.2 \times 10^5$ | $6.1 \times 10^2$ | 6.6 | Wet granulation |
| Comp. Ex. 5 | $5.8 \times 10^7$ | $7.8 \times 10^3$ | 5.1 | Spherical product of pulverized toner |

TABLE 2

| | Lowest fixing temperature ° C. | Hot-offset occurring temperature ° C. | Glossiness % | Overall assessment |
|---|---|---|---|---|
| Example 1 | 120 | 220 or more | 22 | Good |
| Example 2 | 120 | 220 or more | 25 | Good |
| Example 3 | 115 | 220 or more | 26 | Good |
| Example 4 | 120 | 220 or more | 20 | Good |
| Example 5 | 110 | 220 or more | 27 | Good |

TABLE 2-continued

| | Lowest fixing temperature ° C. | Hot-offset occurring temperature ° C. | Glossiness % | Overall assessment |
|---|---|---|---|---|
| Example 6 | 120 | 220 or more | 21 | Good |
| Example 7 | 125 | 220 or more | 18 | Good |
| Comp. Ex. 1 | 140 | 200 | 7 | Failure |
| Comp. Ex. 2 | 140 | 200 | 6 | Failure |
| Comp. Ex. 3 | 145 | 195 | 4 | Failure |
| Comp. Ex. 4 | 155 | 220 or more | 3 | Failure |
| Comp. Ex. 5 | 145 | 220 or more | 5 | Failure |

(1) In an image forming process including the step of fixing an image of a toner on a recording medium, the step of fixing including heating one or more heat-transfer media by a heating element, and pressing the recording medium bearing the toner image to one of the one or more heat-transfer media, at least one of the one or more heat-transfer media is a belt heat-transfer medium and is used with or without the application of a predetermined amount of oil, and the toner is in the form of toner particles, mainly comprises at least a binder resin and a releasing agent, has a weight-average particle diameter Dv of 3.0 μm to 7.0 μm, a particle diameter distribution Dv/Dn of 1.00 or more and 1.25 or less, wherein Dv is the weight-average particle diameter and Dn is a number-average particle diameter, and an average shape factor SF-1 of 100 to 150 and contains toner particles having a shape factor SF-1 of 160 or more in an amount of 10% by number or less. The resulting image forming process and apparatus can exhibit good image fixing properties at low temperature and excellent releasability of the toner.

(2) By using a toner having a weight-average particle diameter Dv of 3.0 μm to 5.0 μm, the image forming process and apparatus can more satisfactorily fix images at low temperature and have better releasability of the toner.

(3) By using a toner having a particle diameter distribution Dv/Dn of from 1.00 to 1.20, wherein Dv is a weight-average particle diameter, and Dn is a number-average particle diameter, the image forming process and apparatus can more satisfactorily fix images at low temperature and exhibit better releasability of the toner.

(4) By using a toner having an average shape factor SF-1 of 100 to from 130, the image forming process and apparatus can further satisfactorily fix images at low temperature.

(5) By using a toner containing toner particles having a shape factor SF-1 of 150 or more in an amount of 10% by number or less, the image forming process and apparatus can further satisfactorily fix images at low temperature.

(6) By using a toner containing spindle toner particles, the image forming process and apparatus can satisfactorily reproduce dots.

(7) By using a toner containing 1% by weight to 20% by weight of a releasing agent having a melting point of 60° C. to 120° C., the image forming process and apparatus can further satisfactorily fix images at low temperature and exhibit better releasability.

(8) It is preferred that the releasing agent in the toner particles is dispersed in the form of particles, dispersed particles of the releasing agent having a particle diameter of 0.1 μm to 3 μm occupy 80% by number or more of the total dispersed particles, and the dispersed particles of the releasing agent are mainly located in the vicinity of a surface of the toner particle as observed with a transmission electron microscope (TEM). Thus, the image forming process and apparatus can further satisfactorily fix images at low temperature and exhibit better releasability.

(9) The toner preferably has a storage modulus G' and a loss modulus G", wherein the storage modulus G' is in the range from $5.5\times10^5$ to $5.5\times10^7$ Pa at 80° C. and is in the range from $5.0\times10^2$ to $1.0\times10^4$ Pa at 180° C., and a maximum of a loss tangent (tan δ=G"/G') is in the range from 1.5 to 8.0 at temperature from 80° C. to 130° C. Thus, the image forming process and apparatus can exhibit satisfactory releasability.

(10) By using a toner containing a binder resin with an acid value of from 1 mg-KOH/g to 50 mg-KOH/g, the image forming process and apparatus can satisfactorily fix images at low temperature.

(11) By using a toner containing a binder resin with a glass transition point Tg of from 40° C. to 60° C., the image forming process and apparatus can satisfactorily fix images at low temperature and show high releasability of the toner.

(12) The binder resin in the toner preferably has a content of THF insoluble components of from 1% by weight to 20% by weight. Thus, the image forming process and apparatus can further satisfactorily fix images at low temperature and show higher releasability of the toner.

(13) It is preferred that the toner contains at least one polyester resin, and the at least one polyester resin contains tetrahydrofuran-soluble components having a molecular weight distribution with a main peak at molecular weights of from 2,500 to 10,000 and with a number-average molecular weight of from 2,500 to 50,000. Thus, the image forming process and apparatus can further satisfactorily fix images at low temperature and show higher releasability of the toner.

(14) The toner is preferably prepared by a method including the steps of dissolving or dispersing, in an organic solvent, an isocyanate-containing polyester prepolymer, a compound capable of undergoing elongation and/or crosslinking with the prepolymer, and at least one toner component to form a solution or dispersion; subjecting the solution or dispersion to a crosslinking reaction and/or an elongation reaction in an aqueous medium to form a dispersion; and removing the solvent from the dispersion. By using this toner, the image forming process and apparatus can further satisfactorily fix images at low temperature and show higher releasability of the toner.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming process, comprising:

fixing a toner image on a recording medium, wherein said fixing comprises:

heating one or more heat-transfer media using a heating element, and pressing the recording medium bearing the toner image to one of the one or more heat-transfer media using a pressurizing member, wherein at least one of the one or more heat-transfer media is a belt heat-transfer medium and the surface thereof is applied with no oil, and wherein the toner image is formed with a toner which comprises a binder resin and a releasing agent, has Dv of from 3.0 μm to 7.0 μm, a particle diameter distribution Dv/Dn of from 1.00 to 1.25, in which Dv is a weight-average particle diameter and Dn is a number-average particle diameter, and an average shape factor SF-1 of from 100 to 150, and contains toner particles having a shape factor SF-1 of 160 or more in an amount of 10% by number or less;

wherein the toner particles have a storage modulus G' and a loss modulus G", wherein the storage modulus G' is in the range from $5.5\times10^5$ Pa to $5.5\times10^7$ Pa at 80° C. and is in the range from $5.0\times10^2$ Pa to $1.0\times10^4$ Pa at 180° C., and a maximum of a loss tangent (tan δ=G"/G') is in the range from 1.5 to 8.0 at temperature from 80° C. to 130° C.;

wherein the releasing agent has a melting point of from 60° C. to 120° C. and is contained in the toner in an amount of from 1% by weight to 20% by weight.

2. An image forming process according to claim 1, wherein the weight-average particle diameter Dv of the toner is in the range of from 3.0 μm to 5.0 μm.

3. An image forming process according to claim 1, wherein the particle diameter distribution Dv/Dn of the toner is in the range of from 1.00 to 1.20.

4. An image forming process according to claim 1, wherein the average shape factor SF-1 of the toner is in the range of from 100 to 130.

5. An image forming process according to claim 1, wherein a content of toner having a shape factor SF-1 of 150 or more in the toner is 10% by number or less.

6. An image forming process according to claim 1, wherein the releasing agent in each toner particle is dispersed in a form of particles, wherein dispersed particles of the releasing agent having a particle diameter of from 0.1 μm to 3 μm occupy 80% by number or more of the total dispersed particles, and wherein the dispersed particles is concentrated in the vicinity of the surface of the toner particle as observed with a transmission electron microscope (TEM).

7. An image forming process according to claim 1, wherein the binder resin has an acid value of from 1 mg-KOH/g to 50 mg-KOH/g.

8. An image forming process according to claim 1, wherein the binder resin has a glass transition point of from 40° C. to 60° C.

9. An image forming process according to claim 1, wherein the binder resin comprises a polyester resin containing a tetrahydrofuran-soluble component, the tetrahydrofuran-soluble component has a molecular weight distribution with a main peak at molecular weights of from 2,500 to 10,000 and with a number-average molecular weight of from 2,500 to 50,000.

10. An image forming process according to claim 1, wherein the toner is a toner which is prepared by: at least one of dissolving and dispersing, in an organic solvent, an isocyanate-containing polyester prepolymer, a compound capable at least one of undergoing elongation and crosslinking with the prepolymer, and at least one toner component to form one of a solution and dispersion; subjecting one of the solution and the dispersion to at least one of a crosslinking reaction and an elongation reaction in an aqueous medium to form a dispersion; and removing the solvent from the dispersion.

* * * * *